US012342847B2

(12) United States Patent
Keller et al.

(10) Patent No.: US 12,342,847 B2
(45) Date of Patent: Jul. 1, 2025

(54) ORAL PRODUCT WITH CELLULOSIC FLAVOR STABILIZER

(71) Applicant: R. J. Reynolds Tobacco Company, Winston-Salem, NC (US)

(72) Inventors: Christopher Keller, Advance, NC (US); Thomas H. Poole, Winston-Salem, NC (US); Ronald K. Hutchens, East Bend, NC (US); Anthony R. Gerardi, Winston-Salem, NC (US)

(73) Assignee: NICOVENTURES TRADING LIMITED, London (GB)

( * ) Notice: Subject to any disclaimer, the term of this patent is extended or adjusted under 35 U.S.C. 154(b) by 1429 days.

(21) Appl. No.: 16/568,003

(22) Filed: Sep. 11, 2019

(65) Prior Publication Data

US 2021/0068446 A1 Mar. 11, 2021

(51) Int. Cl.

| | |
|---|---|
| ***A24B 13/00*** | (2006.01) |
| ***A24B 9/00*** | (2006.01) |
| ***A24B 15/18*** | (2006.01) |
| ***A24B 15/40*** | (2006.01) |

(52) U.S. Cl.

CPC ..... *A24B 15/403* (2013.01); *A24B 9/00* (2013.01); *A24B 13/00* (2013.01); *A24B 15/183* (2013.01)

(58) Field of Classification Search

CPC ..... A24B 15/403; A24B 13/00; A24B 15/183; A24B 5/12; A24B 15/28

USPC ..... 131/111, 302, 352

See application file for complete search history.

(56) References Cited

U.S. PATENT DOCUMENTS

| | | | |
|---|---|---|---|
| 787,611 | A | 4/1905 | Daniels, Jr. et al. |
| 1,086,306 | A | 2/1914 | Oelenheinz |
| 1,376,586 | A | 5/1921 | Schwartz |
| 1,437,095 | A | 11/1922 | Delling |
| 1,757,477 | A | 5/1930 | Rosenhoch |
| 2,033,909 | A | 3/1936 | Cox et al. |
| 2,122,421 | A | 7/1938 | Hawkinson |
| 2,148,147 | A | 2/1939 | Baier |
| 2,170,107 | A | 8/1939 | Baier |
| 2,274,649 | A | 3/1942 | Baier |
| 2,770,239 | A | 11/1956 | Prats et al. |

(Continued)

FOREIGN PATENT DOCUMENTS

| | | |
|---|---|---|
| CN | 103005680 | 4/2013 |
| CN | 103263507 | 8/2013 |

(Continued)

OTHER PUBLICATIONS

Imelson, Alan, Food Stabilisers, Thickeners and Gelling Agents, 2010, Blackwell Publishing Ltd., 1st Edition, p. 95-113. (Year: 2010).*

(Continued)

*Primary Examiner* — Russell E Sparks

(74) *Attorney, Agent, or Firm* — Womble Bond Dickinson (US) LLP; Scott Breining

(57) ABSTRACT

The disclosure provides products configured for oral use, the products including a mixture of a particulate filler component, a cellulose derivative, water, and one or more flavoring agents. The products exhibit greater stability over time with respect to flavor component concentration than comparative products which do not contain a cellulose derivative.

39 Claims, 1 Drawing Sheet

(56) References Cited

U.S. PATENT DOCUMENTS 3,612,065 A 10/1971 Rosen
3,851,653 A 12/1974 Rosen
3,889,689 A 6/1975 Rosen
3,901,248 A 8/1975 Lichtneckert et al.
3,943,940 A 3/1976 Minami
3,943,945 A 3/1976 Rosen
4,143,666 A 3/1979 Rainer
4,144,895 A 3/1979 Fiore
4,148,325 A 4/1979 Solomon et al.
4,150,677 A 4/1979 Osborne, Jr. et al.
4,194,514 A 3/1980 Campbell
4,267,847 A 5/1981 Reid
4,289,147 A 9/1981 Wildman et al.
4,340,073 A 7/1982 de la Burde et al.
4,351,346 A 9/1982 Brummer et al.
4,359,059 A 11/1982 Brummer et al.
4,366,823 A 1/1983 Rainer et al.
4,366,824 A 1/1983 Rainer et al.
4,388,933 A 6/1983 Rainer et al.
4,506,682 A 3/1985 Muller
4,513,756 A 4/1985 Pittman et al.
4,528,993 A 7/1985 Sensabaugh, Jr. et al.
4,589,428 A 5/1986 Keritsis
4,605,016 A 8/1986 Soga et al.
4,624,269 A 11/1986 Story et al.
4,641,667 A 2/1987 Schmekel et al.
4,660,577 A 4/1987 Sensabaugh et al.
4,716,911 A 1/1988 Poulose et al.
4,725,440 A 2/1988 Ridgway et al.
4,727,889 A 3/1988 Niven, Jr. et al.
4,887,618 A 12/1989 Bernasek et al.
4,941,484 A 7/1990 Clapp et al.
4,967,771 A 11/1990 Fagg et al.
4,986,286 A 1/1991 Roberts et al.
4,987,907 A 1/1991 Townsend
4,991,599 A 2/1991 Tibbetts
5,005,593 A 4/1991 Fagg et al.
5,018,540 A 5/1991 Grubbs et al.
5,060,669 A 10/1991 White et al.
5,065,775 A 11/1991 Fagg
5,074,319 A 12/1991 White et al.
5,092,352 A 3/1992 Sprinkle, III et al.
5,099,862 A 3/1992 White et al.
5,121,757 A 6/1992 White et al.
5,131,414 A 7/1992 Fagg
5,131,415 A 7/1992 Munoz et al.
5,148,819 A 9/1992 Fagg
5,167,244 A 12/1992 Kjerstad
5,197,494 A 3/1993 Kramer
5,230,354 A 7/1993 Smith et al.
5,234,008 A 8/1993 Fagg
5,243,999 A 9/1993 Smith
5,259,403 A 11/1993 Guy et al.
5,301,694 A 4/1994 Raymond et al.
5,318,050 A 6/1994 Gonzalez-Parra et al.
5,343,879 A 9/1994 Teague
5,360,022 A 11/1994 Newton
5,387,416 A 2/1995 White et al.
5,417,229 A 5/1995 Summers et al.
5,435,325 A 7/1995 Clapp et al.
5,445,169 A 8/1995 Brinkley et al.
5,539,093 A 7/1996 Fitzmaurice et al.
5,668,295 A 9/1997 Wahab et al.
5,705,624 A 1/1998 Fitzmaurice et al.
5,713,376 A 2/1998 Berger
5,844,119 A 12/1998 Weigl
5,908,032 A 6/1999 Poindexter et al.
6,077,524 A 6/2000 Bolder et al.
6,131,584 A 10/2000 Lauterbach
6,138,683 A 10/2000 Hersh et al.
6,298,859 B1 10/2001 Kierulff et al.
6,510,855 B1 1/2003 Korte et al.
6,668,839 B2 12/2003 Williams
6,730,832 B1 5/2004 Dominguez et al.
6,772,767 B2 8/2004 Mua et al.
6,834,654 B2 12/2004 Williams
6,845,777 B2 1/2005 Pera
6,887,307 B1 5/2005 Scott et al.
6,895,974 B2 5/2005 Peele
6,923,981 B2 8/2005 Leung et al.
6,953,040 B2 10/2005 Atchley et al.
6,958,143 B2 10/2005 Choi et al.
7,014,039 B2 3/2006 Henson et al.
7,025,066 B2 4/2006 Lawson et al.
7,032,601 B2 4/2006 Atchley et al.
7,056,541 B1 6/2006 Stahl et al.
7,173,170 B2 2/2007 Liu et al.
7,208,659 B2 4/2007 Colliver et al.
7,230,160 B2 6/2007 Benning et al.
7,337,782 B2 3/2008 Thompson
7,507,427 B2 3/2009 Andersen et al.
D592,956 S 5/2009 Thiellier
7,537,110 B2 5/2009 Kutsch et al.
D594,154 S 6/2009 Patel
7,556,047 B2 7/2009 Poindexter et al.
7,584,843 B2 9/2009 Kutsch et al.
7,650,892 B1 1/2010 Groves et al.
7,694,686 B2 4/2010 Atchley et al.
7,798,153 B2 9/2010 Lawrence, Jr. et al.
D625,178 S 10/2010 Bailey et al.
7,810,507 B2 10/2010 Dube et al.
7,833,555 B2 11/2010 Andersen et al.
7,861,728 B2 1/2011 Holton, Jr. et al.
7,900,637 B2 3/2011 Fagerstrom et al.
7,950,399 B2 5/2011 Winterson et al.
8,061,362 B2 11/2011 Mua et al.
8,069,861 B2 12/2011 Sinclair
8,124,147 B2 2/2012 Cheng et al.
8,186,360 B2 5/2012 Marshall et al.
8,293,295 B2 10/2012 Andersen et al.
8,336,557 B2 12/2012 Kumar et al.
8,343,532 B2 1/2013 Dam et al.
8,397,945 B2 3/2013 Gelardi et al.
8,424,541 B2 4/2013 Crawford et al.
8,434,496 B2 5/2013 Chen et al.
8,469,036 B2 6/2013 Williams et al.
8,469,037 B2 6/2013 Liu et al.
8,529,875 B2 9/2013 Andersen
8,529,914 B2 9/2013 Fuisz et al.
8,545,870 B2 10/2013 Dupinay et al.
8,591,967 B2 11/2013 Andersen et al.
8,613,285 B2 12/2013 Fuisz
8,627,828 B2 1/2014 Strickland et al.
8,642,016 B2 2/2014 Chau et al.
8,714,163 B2 5/2014 Kumar et al.
8,741,348 B2 6/2014 Hansson et al.
8,747,562 B2 6/2014 Mishra et al.
8,828,361 B2 9/2014 Anderson
8,833,378 B2 9/2014 Axelsson et al.
8,846,075 B2 9/2014 Johnson et al.
8,858,984 B2 10/2014 Dam et al.
8,863,755 B2 10/2014 Zhuang et al.
8,871,243 B2 10/2014 Fankhauser et al.
8,931,493 B2 1/2015 Sebastian et al.
8,944,072 B2 2/2015 Chen et al.
8,945,593 B2 2/2015 LoCoco et al.
8,978,661 B2 3/2015 Atchley et al.
8,991,403 B2 3/2015 Chen et al.
8,992,974 B2 3/2015 McCarty
9,027,567 B2 5/2015 Gee et al.
9,039,839 B2 5/2015 Beeson et al.
9,044,035 B2 6/2015 Jackson et al.
9,084,439 B2 7/2015 Holton, Jr.
9,155,321 B2 10/2015 Cantrell et al.
9,161,567 B2 10/2015 Shikata et al.
9,161,908 B2 10/2015 Nilsson
9,167,835 B2 10/2015 Sengupta et al.
9,185,931 B2 11/2015 Gao et al.
9,204,667 B2 12/2015 Cantrell et al.
9,237,768 B2 1/2016 Carroll et al.
9,237,769 B2 1/2016 Mua et al.
9,358,296 B2 6/2016 McCarty
9,372,033 B2 6/2016 Lampe et al.
9,386,800 B2 7/2016 Sebastian et al.

(56) References Cited

U.S. PATENT DOCUMENTS 9,402,414 B2 8/2016 Griscik et al.
9,402,809 B2 8/2016 Axelsson et al.
9,414,624 B2 8/2016 Carroll et al.
9,420,825 B2 8/2016 Beeson et al.
9,468,233 B2 10/2016 Macko et al.
9,474,303 B2 10/2016 Holton, Jr.
9,521,864 B2 12/2016 Gao et al.
9,565,867 B2 2/2017 Wittorff et al.
9,629,392 B2 4/2017 Holton, Jr.
9,675,102 B2 6/2017 Hunt et al.
9,763,928 B2 9/2017 Duggins et al.
9,775,376 B2 10/2017 Cantrell et al.
9,801,409 B1 10/2017 Smith
9,848,634 B2 12/2017 Fuisz
9,854,830 B2 1/2018 Gao et al.
9,884,015 B2 2/2018 Gao et al.
9,907,748 B2 3/2018 Borschke et al.
9,925,145 B2 3/2018 Hubinette et al.
9,930,909 B2 4/2018 Gao et al.
9,999,243 B2 6/2018 Gao et al.
10,039,309 B2 8/2018 Carroll et al.
10,045,976 B2 8/2018 Fusco et al.
10,092,715 B2 10/2018 Axelsson et al.
10,130,120 B2 11/2018 Mishra et al.
10,143,230 B2 12/2018 Mishra et al.
10,149,850 B2 12/2018 Mishra et al.
10,172,810 B2 1/2019 McCarty
10,244,786 B2 4/2019 Gao et al.
10,334,873 B2 7/2019 Mishra et al.
10,357,054 B2 7/2019 Marshall et al.
10,375,984 B2 8/2019 Hernandez Garcia et al.
10,426,726 B2 10/2019 Neergaard
10,463,070 B2 11/2019 Carroll et al.
10,532,046 B2 1/2020 Rogers et al.
10,543,205 B2 1/2020 Wittorff et al.
10,881,132 B2 * 1/2021 Mua ..... A24B 15/18
2003/0070687 A1 4/2003 Atchley et al.
2004/0020503 A1 2/2004 Williams
2004/0118422 A1 6/2004 Lundin et al.
2004/0191322 A1 9/2004 Hansson
2005/0115580 A1 6/2005 Quinter et al.
2005/0244521 A1 11/2005 Strickland et al.
2006/0191548 A1 8/2006 Strickland et al.
2006/0236434 A1 10/2006 Conkling et al.
2007/0012328 A1 1/2007 Winterson et al.
2007/0031539 A1 2/2007 Calton, Jr.
2007/0062549 A1 3/2007 Holton, Jr. et al.
2007/0186941 A1 8/2007 Holton, Jr. et al.
2007/0186942 A1 8/2007 Strickland et al.
2008/0029110 A1 2/2008 Dube et al.
2008/0029116 A1 2/2008 Robinson et al.
2008/0081071 A1 4/2008 Sanghvi et al.
2008/0166395 A1 7/2008 Roush
2008/0173317 A1 7/2008 Robinson et al.
2008/0196730 A1 8/2008 Engstrom et al.
2008/0209586 A1 8/2008 Neilsen et al.
2008/0305216 A1 12/2008 Crawford et al.
2009/0014343 A1 1/2009 Clark et al.
2009/0014450 A1 1/2009 Bjorkholm
2009/0023819 A1 1/2009 Axelsson
2009/0065013 A1 3/2009 Essen et al.
2009/0095313 A1 4/2009 Fuisz
2009/0223989 A1 9/2009 Gelardi
2009/0230003 A1 9/2009 Thiellier
2009/0250360 A1 10/2009 Bellamah et al.
2009/0253754 A1 10/2009 Selmin et al.
2009/0266837 A1 10/2009 Gelardi et al.
2009/0293889 A1 12/2009 Kumar et al.
2009/0293895 A1 12/2009 Axelsson et al.
2009/0301505 A1 12/2009 Liu et al.
2010/0004294 A1 1/2010 Axelsson et al.
2010/0018541 A1 1/2010 Gerardi et al.
2010/0061940 A1 3/2010 Axelsson et al.
2010/0084424 A1 4/2010 Gelardi et al.
2010/0133140 A1 6/2010 Bailey et al.
2010/0187143 A1 7/2010 Essen et al.
2010/0218779 A1 9/2010 Zhuang et al.
2010/0260690 A1 10/2010 Kristensen et al.
2010/0264157 A1 10/2010 Bailey et al.
2010/0282267 A1 11/2010 Atchley
2010/0291245 A1 11/2010 Gao et al.
2010/0294292 A1 11/2010 Hodin et al.
2010/0326454 A1 12/2010 Morris
2011/0139164 A1 6/2011 Mua et al.
2011/0168712 A1 7/2011 Bailey et al.
2011/0220130 A1 9/2011 Mua et al.
2011/0247640 A1 10/2011 Beeson et al.
2011/0268809 A1 11/2011 Brinkley et al.
2012/0024301 A1 2/2012 Carroll et al.
2012/0031414 A1 2/2012 Atchley et al.
2012/0031415 A1 2/2012 Essen et al.
2012/0037175 A1 2/2012 Cantrell et al.
2012/0055494 A1 3/2012 Hunt et al.
2012/0138073 A1 6/2012 Cantrell et al.
2012/0138074 A1 6/2012 Cantrell et al.
2012/0167902 A1 7/2012 Atchley et al.
2013/0074855 A1 3/2013 Holton, Jr. et al.
2013/0074856 A1 3/2013 Holton, Jr. et al.
2013/0078307 A1 3/2013 Holton, Jr. et al.
2013/0118512 A1 5/2013 Jackson et al.
2013/0152953 A1 6/2013 Mua et al.
2013/0186416 A1 7/2013 Gao et al.
2013/0186418 A1 7/2013 Gao et al.
2013/0274296 A1 7/2013 Jackson et al.
2013/0206150 A1 8/2013 Duggins et al.
2013/0251779 A1 9/2013 Svandal et al.
2013/0312774 A1 11/2013 Holton, Jr.
2013/0340773 A1 12/2013 Sebastian et al.
2014/0017286 A1 1/2014 Nilsson
2014/0130813 A1 5/2014 Strehle
2014/0154301 A1 6/2014 Chau et al.
2014/0255452 A1 9/2014 Reddick et al.
2014/0261472 A1 9/2014 Carroll et al.
2014/0271791 A1 9/2014 Altria
2014/0332013 A1 11/2014 Gao et al.
2015/0068544 A1 3/2015 Moldoveanu et al.
2015/0068545 A1 3/2015 Moldoveanu et al.
2015/0071972 A1 3/2015 Holton, Jr. et al.
2015/0096573 A1 4/2015 Gao et al.
2015/0096574 A1 4/2015 Gao et al.
2015/0096575 A1 4/2015 Gao et al.
2015/0096576 A1 4/2015 Gao et al.
2015/0101627 A1 4/2015 Marshall et al.
2015/0230515 A1 8/2015 Lampe et al.
2015/0296868 A1 10/2015 Sutton
2016/0000140 A1 1/2016 Sebastian et al.
2016/0073676 A1 3/2016 Cantrell et al.
2016/0073689 A1 3/2016 Sebastian et al.
2016/0157515 A1 6/2016 Chapman et al.
2016/0192703 A1 7/2016 Sebastian et al.
2017/0007594 A1 1/2017 Borschke
2017/0164651 A1 6/2017 Mua et al.
2017/0165252 A1 6/2017 Mua et al.
2017/0172995 A1 6/2017 Repaka et al.
2017/0280764 A1 10/2017 Sahlen et al.
2017/0312261 A1 11/2017 Changoer et al.
2017/0318858 A1 11/2017 Hodin et al.
2018/0014568 A1 1/2018 Hernandez Garcia et al.
2018/0051002 A1 2/2018 Dull et al.
2018/0140007 A1 5/2018 Aspgren et al.
2018/0140521 A1 5/2018 Geonnotti et al.
2018/0140554 A1 5/2018 Wittorff
2018/0153211 A1 6/2018 Persson
2018/0235273 A1 8/2018 Carroll et al.
2018/0255826 A1 9/2018 Persson et al.
2018/0257801 A1 9/2018 Persson
2019/0037909 A1 2/2019 Greenbaum et al.
2019/0255035 A1 8/2019 Bruun
2020/0037638 A1 2/2020 Faraci et al.
2020/0128870 A1 4/2020 Hassler et al.
2020/0138706 A1 5/2020 Rudraraju et al.
2020/0275689 A1 9/2020 Lewerenz

(56) References Cited

U.S. PATENT DOCUMENTS

| | | | | |
|---|---|---|---|---|
| 2020/0297026 | A1 | 9/2020 | Kannisto et al. | |
| 2020/0305496 | A1 | 10/2020 | Gessesse | |
| 2022/0225659 | A1 * | 7/2022 | Gessesse | A24B 13/00 |

FOREIGN PATENT DOCUMENTS

| | | | | |
|---|---|---|---|---|
| CN | 103494324 | | 1/2014 | |
| CN | 105192876 | | 12/2015 | |
| CN | 105595404 | | 5/2016 | |
| EP | 2891408 | * | 7/2015 | A24B 15/30 |
| WO | WO 96/31255 | | 10/1996 | |
| WO | WO 2004/095959 | | 11/2004 | |
| WO | WO 2005/041699 | | 5/2005 | |
| WO | WO2005/046363 | | 5/2005 | |
| WO | WO 2005/063060 | | 5/2005 | |
| WO | WO 2008/103935 | | 8/2008 | |
| WO | WO2019/005889 | | 1/2019 | |
| WO | WO2019/036243 | | 2/2019 | |

OTHER PUBLICATIONS

Valerate Ester, Chemical Entities of Biological Interest, European Molecular Biology Laboratory, https://www.ebi.ac.uk/chebi/searchld.do?chebild=CHEBI:50871 (Year: 2019).*

Robichaud Meagan et al., "Tobacco companies introduce 'tobacco free' nicotine pouches", *Tob Control 2019*, Nov. 21, 2019, 1-2, National Library of Medicine, doi:10.1136/tobaccocontrol-2019-055321.

Fahimeh Mohammaei et al: "Coefficient partition prediction of saturated monocarboxylic acids using the molecular descriptors", Journal of the Chilean Chemical Society, vol. 63, No. 3, Jan. 1, 2018 (Jan. 1, 2018), pp. 4068-4071.

International Search Report and Written Opinion for PCT/IB2020/058429, Mailed Nov. 5, 2020.

International Search Report and Written Opinion for PCT/IB2020/058432, Mailed Nov. 2, 2020.

Perfetti, T. A. "Structural study of nicotine salts" *Beitrage Tabakforschung Int.*, 12: 43-54 (1983).

Nestor et al., "Role of Oxides of Nitrogen in Tobacco-Specific Nitrosamine Formation in Flue-Cured Tobacco" *Beitrage Tabakforsch. Int.*, 20, 467-475 (2003).

Roton et al., "Factors Influencing the Formation of Tobacco-Specific Nitrosamines in French Air-Cured Tobaccos in Trials and at the Farm Level" *Beitrage Tabakforsch. Int.*, 21, 305-320 (2005).

Staaf et al., "Formation of Tobacco-Specific Nitrosamines (TSNA) During Air-Curing: Conditions and Control" *Beitrage Tabakforsch. Int.*, 21, 321-330 (2005).

* cited by examiner

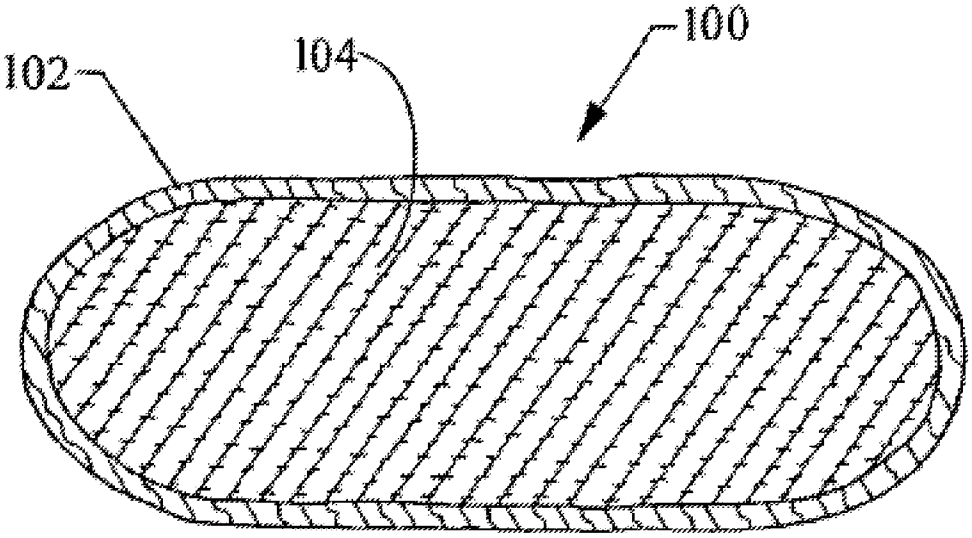
100
104
102

ORAL PRODUCT WITH CELLULOSIC FLAVOR STABILIZER

FIELD OF THE DISCLOSURE

The present disclosure relates to flavored products intended for human consumption. The products are configured for oral use and deliver substances such as flavors and/or active ingredients during use. Such products may include tobacco or a product derived from tobacco, or may be tobacco-free alternatives.

BACKGROUND

Tobacco may be enjoyed in a so-called "smokeless" form. Particularly popular smokeless tobacco products are employed by inserting some form of processed tobacco or tobacco-containing formulation into the mouth of the user. Conventional formats for such smokeless tobacco products include moist snuff, snus, and chewing tobacco, which are typically formed almost entirely of particulate, granular, or shredded tobacco, and which are either portioned by the user or presented to the user in individual portions, such as in single-use pouches or sachets. Other traditional forms of smokeless products include compressed or agglomerated forms, such as plugs, tablets, or pellets. Alternative product formats, such as tobacco-containing gums and mixtures of tobacco with other plant materials, are also known. See for example, the types of smokeless tobacco formulations, ingredients, and processing methodologies set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0209586 to Neilsen et al.; 2009/0065013 to Essen et al.; and 2010/0282267 to Atchley, as well as WO2004/095959 to Arnarp et al., each of which is incorporated herein by reference.

Smokeless tobacco product configurations that combine tobacco material with various binders and fillers have been proposed more recently, with example product formats including lozenges, pastilles, gels, extruded forms, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference.

All-white snus portions are growing in popularity, and offer a discrete and aesthetically pleasing alternative to traditional snus. Such modern "white" pouched products may include a bleached tobacco or may be tobacco-free.

Products of this type may suffer from certain drawbacks, such as poor product stability that could lead to discoloration of the product and/or undesirable organoleptic characteristics. Accordingly, it would be desirable in the art to provide products configured for oral use with enhanced stability to provide a more enjoyable user experience.

BRIEF SUMMARY

The present disclosure generally provides products configured for oral use, and further provides methods for stabilizing flavor components present in the products. The products are intended to impart a taste when used orally and to deliver substances to the consumer, for example, nicotine. The products and methods rely on the surprising finding that including a cellulose derivative in the product improves the retention of certain volatile flavor components relative to comparable products which do not include a cellulose derivative. Accordingly, in one aspect, the disclosure provides a product configured for oral use, the product comprising a mixture comprising a particulate filler component, a cellulose derivative, water in an amount of at least about 5% by weight, and one or more flavoring agents.

In some embodiments, the product comprises at least about 0.5% by weight of the cellulose derivative, based on the total weight of the mixture. In some embodiments, the product comprises at least about 1% by weight of the cellulose derivative, based on the total weight of the mixture. In some embodiments, the product comprises from about 1% to about 5% by weight of the cellulose derivative, based on the total weight of the mixture.

In some embodiments, the cellulose derivative is a cellulose ether. In some embodiments, the cellulose derivative is one or more of methylcellulose, hydroxyethyl cellulose, hydroxypropylcellulose (HPC), hydroxypropylmethylcellulose (HPMC), or carboxymethylcellulose (CMC). In some embodiments, the cellulose derivative is HPC.

In some embodiments, the particulate filler component comprises a cellulose material, a starch, or both. In some embodiments, the particulate filler component comprises microcrystalline cellulose.

In some embodiments, the one or more flavoring agents comprise a compound having a carbon-carbon double bond, a carbon-oxygen double bond, a carbon-oxygen single bond, or a combination thereof. In some embodiments, the one or more flavoring agents comprise one or more aldehydes, ketones, esters, terpenes, terpenoids, or a combination thereof. In some embodiments, the one or more flavoring agents comprise one or more esters. In some embodiments, the one or more esters are alkyl esters comprising a $C_1$-$C_8$ alkanol and a $C_2$-$C_8$ alkane carboxylic acid. In some embodiments, the one or more esters comprise isoamyl acetate, ethyl hexanoate, ethyl heptanoate, allyl hexanoate, or a combination thereof.

In some embodiments, the product comprises from about 1 to about 3% by weight of HPC; from about 10 to about 60% by weight of microcrystalline cellulose; and from about 1 to about 60% by weight of water, based on the total weight of the mixture.

In some embodiments, the mixture further comprises one or more salts, one or more organic acids, one or more sweeteners, one or more binding agents, one or more humectants, one or more gums, one or more active ingredients, a tobacco material, or combinations thereof. In some embodiments, the mixture further comprises one or more active ingredients selected from the group consisting of a nicotine component, botanicals, stimulants, amino acids, vitamins, and cannabinoids. In some embodiments, the mixture further comprises from about 0.001 to about 10% by weight of a nicotine component, calculated as the free base and based on the total weight of the mixture.

In some embodiments, the mixture comprises no more than about 7.5 percent of alkali metal salt, based on the total weight of the mixture. In some embodiments, the mixture further comprises from about 0.1 to about 0.5% by weight of one or more organic acids, based on the total weight of the mixture. In some embodiments, the one or more organic acids is an alkyl carboxylic acid, an aryl carboxylic acid, or a combination of any thereof. In some embodiments, the one or more organic acids is citric acid, malic acid, tartaric acid, octanoic acid, benzoic acid, a toluic acid, salicylic acid, or a combination thereof. In some embodiments, the one or more organic acids is citric acid.

In some embodiments, the mixture further comprises a tobacco material. In some embodiments, the mixture comprises no more than about 10% by weight of the tobacco material, excluding any nicotine component present, based on the total weight of the mixture. In some embodiments, the tobacco material is a bleached tobacco.

In some embodiments, the mixture is enclosed in a pouch to form a pouched product. In some embodiments, the mixture enclosed in the pouch is in a free-flowing particulate form.

In some embodiments, when measured at a time period of 1 day after preparation, the product has a concentration of one or more flavoring agents present which is greater than a concentration of the same one or more flavoring agents present in a control product which does not include the cellulose derivative, as determined by semi-quantitative Gas Chromatography-Mass Spectrometry. In some embodiments, the time period is one or more of 2 days, 1 week, 2 weeks, 3 weeks, or 1 month after preparation.

In another aspect is provided a method of stabilizing a product configured for oral use as disclosed herein, the method comprising i) mixing one or more flavoring agents with a cellulose derivative to form a first mixture; and ii) mixing the first mixture with a particulate filler component and water to form the product.

In some embodiments, the cellulose derivative is a cellulose ether. In some embodiments, the cellulose derivative is one or more of methylcellulose, hydroxyethyl cellulose, hydroxypropylcellulose (HPC), hydroxypropylmethylcellulose (HPMC), or carboxymethylcellulose (CMC). In some embodiments, the cellulose derivative is HPC.

In some embodiments, the particulate filler component comprises a cellulose material, a starch, or both. In some embodiments, the particulate filler component comprises microcrystalline cellulose.

In some embodiments, the one or more flavoring agents comprise one or more aldehydes, ketones, esters, terpenes, terpenoids, or a combination thereof. In some embodiments, the one or more flavoring agents comprise one or more esters. In some embodiments, the one or more esters are alkyl esters comprising a $C_1$-$C_8$ alkanol and a $C_2$-$C_8$ alkyl carboxylic acid. In some embodiments, the one or more esters comprise isoamyl acetate, ethyl hexanoate, ethyl heptanoate, allyl hexanoate, or a combination thereof.

In some embodiments, mixing the first mixture with the particulate filler component further comprises adding one or more salts, one or more sweeteners, one or more binding agents, one or more humectants, one or more gums, one or more active ingredients, a tobacco material, or combinations thereof, to the mixture of step ii). In some embodiments, the method further comprises adding one or more active ingredients selected from the group consisting of a nicotine component, botanicals, stimulants, amino acids, vitamins, and cannabinoids. In some embodiments, mixing the first mixture with the particulate filler component further comprises adding from about 0.001 to about 10% by weight of a nicotine component, calculated as the free base and based on the total weight of the product. In some embodiments, the method further comprises adding from about 0.1 to about 0.5% by weight of one or more organic acids, based on the total weight of the product. In some embodiments, the one or more organic acids is an alkyl carboxylic acid, an aryl carboxylic acid, or a combination of any thereof. In some embodiments, the one or more organic acids is citric acid, malic acid, tartaric acid, octanoic acid, benzoic acid, a toluic acid, salicylic acid, or a combination thereof. In some embodiments, the one or more organic acids is citric acid.

In some embodiments, the method further comprises enclosing the product in a pouch to form a pouched product, the product optionally being in a free-flowing particulate form.

In some embodiments, when measured at a time period of 1 day after preparation, the product has a concentration of one or more of one or more flavoring agents present which is greater than a concentration of the same one or more flavoring agents present in a control product which does not include the cellulose derivative, as determined by semi-quantitative Gas Chromatography-Mass Spectrometry. In some embodiments, the time period is one or more of 2 days, 1 week, 2 weeks, 3 weeks, or 1 month after preparation.

In another aspect is provided a product configured for oral use, the product prepared by the method disclosed herein.

In another aspect is provided a flavor stabilized product configured for oral use, the product comprising a mixture comprising a particulate filler component; a cellulose derivative; water in an amount of at least about 5% by weight, based on the total weight of the mixture; and one or more flavoring agents, wherein the flavor is stabilized by the cellulose derivative.

The disclosure includes, without limitations, the following embodiments.

Embodiment 1: A product configured for oral use, the product comprising a mixture comprising a particulate filler component; a cellulose derivative; water in an amount of at least about 5% by weight, based on the total weight of the mixture; and one or more flavoring agents.

Embodiment 2: The product of the preceding embodiment, comprising at least about 0.5% by weight of the cellulose derivative, based on the total weight of the mixture.

Embodiment 3: The product of any preceding embodiment, comprising at least about 1% by weight of the cellulose derivative, based on the total weight of the mixture.

Embodiment 4: The product of any preceding embodiment, comprising from about 1% to about 5% by weight of the cellulose derivative, based on the total weight of the mixture.

Embodiment 5: The product of any preceding embodiment, wherein the cellulose derivative is a cellulose ether.

Embodiment 6: The product of any preceding embodiment, wherein the cellulose derivative is one or more of methylcellulose, hydroxyethyl cellulose, hydroxypropylcellulose (HPC), hydroxypropylmethylcellulose (HPMC), or carboxymethylcellulose (CMC).

Embodiment 7: The product of any preceding embodiment, wherein the cellulose derivative is hydroxypropylcellulose (HPC).

Embodiment 8: The product of any preceding embodiment, wherein the particulate filler component comprises a cellulose material, a starch, or both.

Embodiment 9: The product of any preceding embodiment, wherein the particulate filler component comprises microcrystalline cellulose.

Embodiment 10: The product of any preceding embodiment, wherein the one or more flavoring agents comprises a compound having a carbon-carbon double bond, a carbon-oxygen double bond, a carbon-oxygen single bond, or a combination thereof.

Embodiment 11: The product of any preceding embodiment, wherein the one or more flavoring agents comprises one or more aldehydes, ketones, esters, terpenes, terpenoids, or a combination thereof.

Embodiment 12: The product of any preceding embodiment, wherein the one or more flavoring agents comprises one or more esters.

Embodiment 13: The product of any preceding embodiment, wherein the one or more esters are alkyl esters comprising a $C_1$-$C_8$ alkanol and a $C_2$-$C_8$ alkane carboxylic acid.

Embodiment 14: The product of any preceding embodiment, wherein the one or more esters comprise isoamyl acetate, ethyl hexanoate, ethyl heptanoate, allyl hexanoate, or a combination thereof.

Embodiment 15: The product of any preceding embodiment, comprising from about 1 to about 3% by weight of hydroxypropylcellulose (HPC); from about 10 to about 60% by weight of microcrystalline cellulose; and from about 1 to about 60% by weight of water, based on the total weight of the mixture.

Embodiment 16: The product of any preceding embodiment, wherein the mixture further comprises one or more salts, one or more organic acids, one or more sweeteners, one or more binding agents, one or more humectants, one or more gums, one or more active ingredients, a tobacco material, or combinations thereof.

Embodiment 17: The product of any preceding embodiment, wherein the mixture further comprises one or more active ingredients selected from the group consisting of a nicotine component, botanicals, stimulants, amino acids, vitamins, and cannabinoids.

Embodiment 18: The product of any preceding embodiment, wherein the mixture further comprises from about 0.001 to about 10% by weight of a nicotine component, calculated as the free base and based on the total weight of the mixture.

Embodiment 19: The product of any preceding embodiment, wherein the mixture further comprises from about 0.1 to about 0.5% by weight of one or more organic acids, based on the total weight of the mixture.

Embodiment 20: The product of any preceding embodiment, wherein the one or more organic acids is an alkyl carboxylic acid, an aryl carboxylic acid, or a combination of any thereof.

Embodiment 21: The product of any preceding embodiment, wherein the one or more organic acids is citric acid, malic acid, tartaric acid, octanoic acid, benzoic acid, a toluic acid, salicylic acid, or a combination thereof.

Embodiment 22: The product of any preceding embodiment, wherein the one or more organic acids is citric acid.

Embodiment 23: The product of any preceding embodiment, wherein the mixture further comprises a tobacco material.

Embodiment 24: The product of of any preceding embodiment, wherein the mixture comprises no more than about 10% by weight of the tobacco material, excluding any nicotine component present, based on the total weight of the mixture.

Embodiment 25: The product of any preceding embodiment, wherein the tobacco material is a bleached tobacco.

Embodiment 26: The product of any preceding embodiment, wherein the mixture comprises no more than about 7.5 percent of alkali metal salt, based on the total weight of the mixture.

Embodiment 27: The product of any preceding embodiment, wherein the mixture is enclosed in a pouch to form a pouched product, the mixture optionally being in a free-flowing particulate form.

Embodiment 28: The product of any preceding embodiment, wherein, when measured at a time period of 1 day after preparation, the product has a concentration of one or more flavoring agents present which is greater than a concentration of the same one or more flavoring agents present in a control product which does not include the cellulose derivative, as determined by semi-quantitative Gas Chromatography-Mass Spectrometry.

Embodiment 29: The product of any preceding embodiment, wherein the time period is one or more of 2 days, 1 week, 2 weeks, 3 weeks, or 1 month after preparation.

Embodiment 30: A method of stabilizing a product configured for oral use, the method comprising mixing one or more flavoring agents with a cellulose derivative to form a first mixture; and mixing the first mixture with a particulate filler component and water to form the product.

Embodiment 31: The method of any preceding embodiment, wherein the cellulose derivative is a cellulose ether.

Embodiment 32: The method of any preceding embodiment, wherein the cellulose derivative is one or more of methylcellulose, hydroxyethyl cellulose, hydroxypropylcellulose (HPC), hydroxypropylmethylcellulose (HPMC), or carboxymethylcellulose (CMC).

Embodiment 33: The method of any preceding embodiment, wherein the cellulose derivative is HPC.

Embodiment 34: The method of any preceding embodiment, wherein the particulate filler component comprises a cellulose material, a starch, or both.

Embodiment 35: The method of any preceding embodiment, wherein the particulate filler component comprises microcrystalline cellulose.

Embodiment 36: The method of any preceding embodiment, wherein the one or more flavoring agents comprise one or more aldehydes, ketones, esters, terpenes, terpenoids, or a combination thereof.

Embodiment 37: The method of any preceding embodiment, wherein the one or more flavoring agents comprise one or more esters.

Embodiment 38: The method of any preceding embodiment, wherein the one or more esters are alkyl esters comprising a $C_1$-$C_8$ alkanol and a $C_2$-$C_8$ alkyl carboxylic acid.

Embodiment 39: The method of any preceding embodiment, wherein the one or more esters comprise isoamyl acetate, ethyl hexanoate, ethyl heptanoate, allyl hexanoate, or a combination thereof.

Embodiment 40: The method of any preceding embodiment, wherein mixing the first mixture with the particulate filler component further comprises adding one or more salts, one or more sweeteners, one or more binding agents, one or more humectants, one or more gums, one or more active ingredients, a tobacco material, or combinations thereof.

Embodiment 41: The method of any preceding embodiment, wherein mixing the first mixture with the particulate filler component further comprises adding one or more active ingredients selected from the group consisting of a nicotine component, botanicals, stimulants, amino acids, vitamins, and cannabinoids.

Embodiment 42: The method of any preceding embodiment, further comprising adding from about 0.001 to about 10% by weight of a nicotine component, calculated as the free base and based on the total weight of the product.

Embodiment 43: The method of any preceding embodiment, further comprising adding from about 0.1 to about 0.5% by weight of one or more organic acids, based on the total weight of the product.

Embodiment 44: The method of any preceding embodiment, wherein the one or more organic acids is an alkyl carboxylic acid, an aryl carboxylic acid, or a combination of any thereof.

Embodiment 45: The method of any preceding embodiment, wherein the one or more organic acids is citric acid, malic acid, tartaric acid, octanoic acid, benzoic acid, a toluic acid, salicylic acid, or a combination thereof.

Embodiment 46: The method of any preceding embodiment, wherein the one or more organic acids is citric acid.

Embodiment 47: The method of any preceding embodiment, further comprising enclosing the product in a pouch to form a pouched product, the product optionally being in a free-flowing particulate form.

Embodiment 48: The method of any preceding embodiment wherein, when measured at a time period of 1 day after preparation, the product has a concentration of one or more flavoring agents present which is greater than a concentration of the same one or more flavoring agents present in a control product which does not include the cellulose derivative, as determined by semi-quantitative Gas Chromatography-Mass Spectrometry.

Embodiment 49: The method of any preceding embodiment, wherein the time period is one or more of 2 days, 1 week, 2 weeks, 3 weeks, or 1 month after preparation.

Embodiment 50: A product configured for oral use, the product prepared by the method of any preceding embodiment.

Embodiment 51: A flavor-stabilized product configured for oral use, the product comprising one or more flavoring agents stabilized by a cellulose derivative, the cellulose derivative optionally selected from the group consisting of methylcellulose, hydroxyethyl cellulose, hydroxypropylcellulose (HPC), hydroxypropylmethylcellulose ((HPMC), or carboxymethylcellulose (CMC).

These and other features, aspects, and advantages of the disclosure will be apparent from a reading of the following detailed description together with the accompanying drawing, which is briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWING

Having thus described aspects of the disclosure in the foregoing general terms, reference will now be made to the accompanying drawing, which is not necessarily drawn to scale. The drawing is exemplary only, and should not be construed as limiting the disclosure.

The drawing is a cross-sectional view of a pouched product embodiment, taken across the width of the product, showing an outer pouch filled with a mixture of the present disclosure.

DETAILED DESCRIPTION

The present disclosure provides products which exhibit enhanced flavor stability, and methods for stabilizing flavor components in such products. For customer satisfaction, it is desirable to provide products adapted for oral use which retain certain initial characteristics, such as an initial flavor profile. Surprisingly, according to the present disclosure, it has been found that in certain embodiments, products comprising a particulate filler component, a cellulose derivative, water in an amount of at least about 5% by weight, and one or more flavoring agents provide enhanced retention of some volatile flavor components present, relative to a control product which does not include the cellulose derivative.

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). Reference to "wet weight" refers to the weight of the composition including water. Unless otherwise indicated, reference to "weight percent" of a composition reflects the total wet weight of the composition (i.e., including water).

The products as described herein comprise a mixture comprising a cellulose derivative, a particulate filler component, water, and one or more flavoring agents. In some embodiments, the mixture further comprises one or more salts, one or more sweeteners, one or more binding agents, one or more humectants, one or more gums, one or more active ingredients, a tobacco material, a tobacco-derived material, or a combination thereof. The relative amounts of the various components within the mixture may vary, and typically are selected so as to provide the desired sensory and performance characteristics to the oral product. The example individual components of the mixture are described herein below.

Particulate Filler Component

Mixtures as described herein typically comprise a particulate filler component. Such particulate filler components may fulfill multiple functions, such as enhancing certain organoleptic properties such as texture and mouthfeel, enhancing cohesiveness or compressibility of the product, and the like. Generally, the filler components are porous particulate materials and are cellulose-based. For example, suitable filler components are any non-tobacco plant material or derivative thereof, including cellulose materials derived from such sources. Examples of cellulosic non-tobacco plant material include cereal grains (e.g., maize, oat, barley, rye, buckwheat, and the like), sugar beet (e.g., FIBREX® brand filler available from International Fiber Corporation), bran fiber, and mixtures thereof. Non-limiting examples of derivatives of non-tobacco plant material include starches (e.g., from potato, wheat, rice, corn), natural cellulose, and modified cellulosic materials. Additional examples of potential filler components include maltodextrin, dextrose, calcium carbonate, calcium phosphate, lactose, mannitol, xylitol, and sorbitol. Combinations of fillers can also be used. In some embodiments, the particulate filler component comprises a starch, a cellulose material, or both.

"Starch" as used herein may refer to pure starch from any source, modified starch, or starch derivatives. Starch is present, typically in granular form, in almost all green plants and in various types of plant tissues and organs (e.g., seeds, leaves, rhizomes, roots, tubers, shoots, fruits, grains, and stems). Starch can vary in composition, as well as in granular shape and size. Often, starch from different sources has different chemical and physical characteristics. A specific starch can be selected for inclusion in the mixture based on the ability of the starch material to impart a specific organoleptic property to composition. Starches derived from various sources can be used. For example, major sources of starch include cereal grains (e.g., rice, wheat, and maize) and root vegetables (e.g., potatoes and cassava). Other examples of sources of starch include acorns, arrowroot, arracacha, bananas, barley, beans (e.g., favas, lentils, mung beans, peas, chickpeas), breadfruit, buckwheat, canna, chestnuts, colacasia, katakuri, kudzu, malanga, millet, oats, oca, Polynesian arrowroot, sago, sorghum, sweet potato, *quinoa*, rye, tapioca, taro, tobacco, water chestnuts, and yams. Certain starches are modified starches. A modified starch has undergone one or more structural modifications, often designed to alter its high heat properties. Some starches have been developed by genetic modifications, and are considered to be "modified" starches. Other starches are obtained and subsequently modified. For example, modified starches can be starches that have been subjected to chemical reactions, such as esterification, etherification, oxidation, depolymerization (thinning) by acid catalysis or oxidation in the presence of base, bleaching, transglycosylation and depolymerization (e.g., dextrinization in the presence of a catalyst), cross-linking, enzyme treatment, acetylation, hydroxypropylation, and/or partial hydrolysis. Other starches are modified by heat treatments, such as pregelatinization, dextrinization, and/or cold water swelling processes. Certain modified starches include monostarch phosphate, distarch glycerol, distarch phosphate esterified with sodium trimetaphosphate, phosphate distarch phosphate, acetylated distarch phosphate, starch acetate esterified with acetic anhydride, starch acetate esterified with vinyl acetate, acetylated distarch adipate, acetylated distarch glycerol, hydroxypropyl starch, hydroxypropyl distarch glycerol, starch sodium octenyl succinate.

In some embodiments, the particulate filler component comprises a cellulose material. One non-limiting example of a suitable cellulose material for use in the products described herein is microcrystalline cellulose ("mcc"). The mcc may be synthetic or semi-synthetic, or it may be obtained entirely from natural celluloses. The mcc may be a product available commercially under the tradenames AVICEL® (DUPONT NUTRITION USA), VIVACEL® (Microcellulose Weissenborn GmbH & Co), or EMCOCEL® (J. Rettenmaier & Sohne GmbH). The mcc may be selected from the group consisting of AVICEL® grades PH-100, PH-102, PH-103, PH-105, PH-112, PH-113, PH-200, PH-300, PH-302, VIVACEL® grades 101, 102, 12, 20 and EMCOCEL® grades 50M and 90M, and the like, and mixtures thereof. In some embodiments, the particulate filler component comprises mcc. In some embodiments, the filler component is mcc.

The quantity of the particulate filler component (e.g., mcc) present in mixtures as described herein may vary according to the desired properties but is typically up to about 97 dry weight percent, and certain embodiments are characterized by a filler content of up to about 10 dry weight percent. The amount of filler component on a wet-weight basis can vary, but is typically up to about 75 percent of the total composition by weight. A typical range of filler component within the mixture can be from about 10 to about 75 percent by total weight of the composition, for example, from about 10, about 15, about 20, about 25, or about 30, to about 35, about 40, about 45, about 50, about 55, about 60, about 65, about 70, or about 75 weight percent (e.g., about 15 to about 60 weight percent, or about 25 to about 45 weight percent) on a wet-weight basis. In certain embodiments, the amount of particulate filler component is at least about 10 percent by weight, such as at least about 20 percent, or at least about 25 percent, or at least about 30 percent, or at least about 35 percent, or at least about 40 percent, based on the total weight of the mixture.

Cellulose Derivative

Mixtures as described herein comprise a cellulose derivative. By "cellulose derivative" is meant a cellulosic material which has been chemically modified by reaction of one or more hydroxyl groups of the cellulose polymer structure with, for example, an esterifying or alkylating agent. Cellulose derivatives include, but are not limited to, any derivative of cellulose such as cellulose esters and cellulose ethers. By "cellulose ester" is meant a cellulose structure with the hydrogen of one or more hydroxyl groups in the cellulose polymer structure replaced with, for example, an acyl, nitro, or sulfate group. Cellulose esters may be organic esters (e.g., cellulose acetate, cellulose triacetate, cellulose propionate, cellulose acetate propionate (CAP), cellulose acetate butyrate (CAB)), or inorganic esters (e.g., nitrocellulose (cellulose nitrate), and cellulose sulfate). By "cellulose ether" is meant a cellulose structure with the hydrogen of one or more hydroxyl groups in the cellulose polymer structure replaced with an alkyl, hydroxyalkyl, or aryl group. Cellulose ethers include, for example, alkyl ethers (e.g., methyl cellulose, ethyl cellulose), hydroxyalkyl (e.g., hydroxyethyl cellulose, hydroxypropyl cellulose (HPC), hydroxyethylmethyl cellulose, hydroxypropylmethyl cellulose (HMPC), ethylhydroxyethyl cellulose), and carboxyalkyl ethers (e.g., carboxymethylcellulose (CMC)).

The amount of cellulose derivative present in the mixture may vary. In some embodiments, the mixture comprises a cellulose derivative in an amount of at least about 0.5% by weight of the cellulose derivative, based on the total weight of the mixture. In some embodiments, the mixture comprises a cellulose derivative in an amount of at least about 1% by weight of a cellulose derivative, based on the total weight of the composition. In some embodiments, the mixture comprises a cellulose derivative in an amount of from about 0.5 to about 10% by weight, based on the total weight of the composition. In some embodiments, the mixture comprises a cellulose derivative in an amount of from about 1 to about 5% by weight of the cellulose derivative, for example, from about 1, about 1.5, about 2, about 2.5, or about 3, to about 3.5, about 4, about 4.5, or about 5% by weight. In some embodiments, the mixture comprises a cellulose derivative in an amount of from about 1 to about 3% by weight, based on the total weight of the mixture.

In some embodiments, the cellulose derivative is a cellulose ether. In some embodiments, the cellulose ether is an alkyl ether or hydroxyalkyl ether. In one embodiment, the cellulose ether comprises one or more of methylcellulose, HPC, HPMC, hydroxyethyl cellulose, or CMC. In one embodiment, the cellulose ether is HPC. In specific embodiments, the mixture comprises from about 1 to about 3% HPC by weight, based on the total weight of the mixture.

Water

The water content of the mixture, prior to use by a consumer of the product, may vary according to the desired properties. Typically, the mixture, as present within the product prior to insertion into the mouth of the user, is less than about 60 percent by weight of water, and generally is from about 1 to about 60% by weight of water, for example, from about 5 to about 55, about 10 to about 50, about 20 to about 45, or about 25 to about 40 percent water by weight, based on the total weight of the mixture. In some embodiments, the mixture is at least about 5% water, for example, from about 5 to about 60% water by weight, based on the total weight of the mixture. In specific embodiments, the mixture comprises from about 1 to about 3% by weight of HPC, from about 10 to about 60% by weight of microcrystalline cellulose; and from about 1 to about 60% by weight of water.

Flavoring Agent

The mixture as disclosed herein comprises one or more flavoring agents. As used herein, a "flavoring agent" or "flavorant" is any flavorful or aromatic substance capable of altering the sensory characteristics associated with the smokeless tobacco composition. Examples of sensory characteristics that can be modified by the flavoring agent include taste, mouthfeel, moistness, coolness/heat, and/or fragrance/aroma. Flavoring agents may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, *eucalyptus*, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as *eucalyptus*. These flavors may be provided neat (i.e., alone) or in a composite, and may be employed as concentrates or flavor packages (e.g., spearmint and menthol, orange and cinnamon; lime, tropical, and the like). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. In some instances, the flavoring agent may be provided in a spray-dried form or a liquid form.

The flavoring agent generally comprises at least one volatile flavor component. As used herein, "volatile" refers to a chemical substance that forms a vapor readily at ambient temperatures (i.e., a chemical substance that has a high vapor pressure at a given temperature relative to a nonvolatile substance). Typically, a volatile flavor component has a molecular weight below about 400, and will often include at least one carbon-carbon double bond, carbon-oxygen double bond, carbon-oxygen single bond, or combinations thereof. In one embodiment, the at least one volatile flavor component comprises one or more alcohols, aldehydes, aromatic hydrocarbons, ketones, esters, terpenes, terpenoids, or a combination thereof. Non-limiting examples of aldehydes include vanillin, ethyl vanillin, p-anisaldehyde, hexanal, furfural, isovaleraldehyde, cuminaldehyde, benzaldehyde, and citronellal. Non-limiting examples of ketones include 1-hydroxy-2-propanone and 2-hydroxy-3-methyl-2-cyclopentenone-1-one. Non-limiting examples of terpenes include sabinene, limonene, gamma-terpinene, beta-farnesene, nerolidol, thujone, myrcene, geraniol, nerol, citronellol, linalool, and eucalyptol.

In some embodiments, the at least one volatile flavor component comprises one or more esters. As used herein, the term "ester" refers to a chemical compound derived from a carboxylic acid and an alcohol, in which the —OH of the carboxyl ($CO_2H$) group has been replaced by the —O-alkyl (alkoxy) group of the alcohol. In some embodiments, the one or more esters are alkyl esters comprising a $C_1$-$C_8$ alkanol and a $C_2$-$C_8$ alkyl carboxylic acid.

By "$C_1$-$C_8$ alkanol" is meant any straight chain or branched chain hydrocarbon alcohol having from one to eight carbons. The alkanol may be saturated (i.e., having all $sp^3$ carbon atoms), or may be unsaturated (i.e., having at least one site of unsaturation). As used herein, the term "unsaturated" refers to the presence of a carbon-carbon, $sp^2$ double bond in one or more positions within the hydrocarbon chain of the alkanol. Unsaturated alkanols may be mono- or polyunsaturated. Representative straight chain alkanols include, but are not limited to, methyl, ethyl, n-propyl, n-butyl, n-pentyl, and n-hexyl. Unsaturated alkanols include, but are not limited to, allyl, butenyl, and the like. Branched chain alkanols include, but are not limited to, isopropyl, sec-butyl, isobutyl, tert-butyl, isopentyl, and 2-methylbutyl.

By "$C_2$-$C_8$ alkyl carboxylic acid" is meant any straight chain or branched chain hydrocarbon carboxylic acid having from two to eight carbons. As with the alkanols as defined above, the alkyl group of the $C_2$-$C_8$ alkyl carboxylic acid may be branched or straight chain, and saturated or unsaturated. Non limiting examples of alkyl carboxylic acids include formic, acetic, propionic, butyric, pentanoic, hexanoic, heptanoic and octanoic acids.

Non-limiting examples of alkyl esters include allyl hexanoate, ethyl heptanoate, ethyl hexanoate, isoamyl acetate, and 3-methylbutyl acetate. In one embodiment, the one or more esters present in the at least one volatile flavor component comprise isoamyl acetate, ethyl hexanoate, ethyl heptanoate, allyl hexanoate, or a combination thereof.

The amount of flavoring agent utilized in the mixture can vary, but is typically up to about 10 weight percent, and certain embodiments are characterized by a flavoring agent content of at least about 0.5 weight percent, such as about 0.5 to about 10 weight percent, about 1 to about 6 weight percent, or about 2 to about 5 weight percent.

The amount of flavoring agent (e.g., the volatile components) present within the mixture may vary over a period of time (e.g., during a period of storage after preparation of the composition). For example, certain volatile components such as esters, ketones, and the like which are present in the mixture (for instance, introduced in the form of a flavor package such as lime, tropical, cinnamon, and the like) may evaporate or undergo chemical transformations, leading to a reduction in the concentration of one or more of the volatile flavor components. In one embodiment, a concentration of one or more of the at least one volatile flavor components present is greater than a concentration of the same one or more volatile flavor components present in a control mixture which does not include the cellulose derivative.

Organic Acid

As used herein, the term "organic acid" refers to an organic (i.e., carbon-based) compound that is characterized by acidic properties. Typically, organic acids are relatively weak acids (i.e., they do not dissociate completely in the presence of water), such as carboxylic acids (—$CO_2H$) or sulfonic acids (—$SO_2OH$). As used herein, reference to organic acid means an organic acid that is intentionally added. In this regard, an organic acid may be intentionally added as a specific composition ingredient as opposed to merely being inherently present as a component of another composition ingredient (e.g., the small amount of organic acid which may inherently be present in a composition ingredient such as a tobacco material). In some embodiments, the one or more organic acids are added neat (i.e., in their free acid, native solid or liquid form) or as a solution in, e.g., water. In some embodiments, the one or more organic acids are added in the form of a salt, as described herein below.

Suitable organic acids will typically have a range of lipophilicities (i.e., a polarity giving an appropriate balance of water and organic solubility). Lipophilicity is conveniently measured in terms of logP, the partition coefficient of a molecule between an aqueous and lipophilic phase, usually water and octanol, respectively. In some embodiments, the organic acid has a logP value of from about 1.5 to about 5.0, e.g., from about 1.5, about 2.0, about 2.5, or about 3.0, to about 3.5, about 4.0, about 4.5, or about 5.0.

In some embodiments, the organic acid is a carboxylic acid or a sulfonic acid. The carboxylic acid or sulfonic acid functional group may be attached to any alkyl, cycloalkyl, heterocycloalkyl, aryl, or heteroaryl group having, for example, from one to twenty carbon atoms ($C_1$-$C_{20}$). In some embodiments, the organic acid is an alkyl, cycloalkyl, heterocycloalkyl, aryl, or heteroaryl carboxylic or sulfonic acid.

As used herein, "alkyl" refers to any straight chain or branched chain hydrocarbon. The alkyl group may be saturated (i.e., having all $sp^3$ carbon atoms), or may be unsaturated (i.e., having at least one site of unsaturation). As used herein, the term "unsaturated" refers to the presence of a carbon-carbon, $sp^2$ double bond in one or more positions within the alkyl group. Unsaturated alkyl groups may be mono- or polyunsaturated. Representative straight chain alkyl groups include, but are not limited to, methyl, ethyl, n-propyl, n-butyl, n-pentyl, and n-hexyl. Branched chain alkyl groups include, but are not limited to, isopropyl, sec-butyl, isobutyl, tert-butyl, isopentyl, and 2-methylbutyl. Representative unsaturated alkyl groups include, but are not limited to, ethylene or vinyl, allyl, 1-butenyl, 2-butenyl, isobutylenyl, 1-pentenyl, 2-pentenyl, 3-methyl-1-butenyl, 2-methyl-2-butenyl, 2,3-dimethyl-2-butenyl, and the like. An alkyl group can be unsubstituted or substituted.

"Cycloalkyl" as used herein refers to a carbocyclic group, which may be mono- or bicyclic. Cycloalkyl groups include rings having 3 to 7 carbon atoms as a monocycle or 7 to 12 carbon atoms as a bicycle. Examples of monocyclic cycloalkyl groups include cyclopropyl, cyclobutyl, cyclopentyl, cyclohexyl, cycloheptyl, and cyclooctyl. A cycloalkyl group can be unsubstituted or substituted, and may include one or more sites of unsaturation (e.g., cyclopentenyl or cyclohexenyl).

The term "aryl" as used herein refers to a carbocyclic aromatic group. Examples of aryl groups include, but are not limited to, phenyl and naphthyl. An aryl group can be unsubstituted or substituted.

"Heteroaryl" and "heterocycloalkyl" as used herein refer to an aromatic or non-aromatic ring system, respectively, in which one or more ring atoms is a heteroatom, e.g. nitrogen, oxygen, and sulfur. The heteroaryl or heterocycloalkyl group comprises up to 20 carbon atoms and from 1 to 3 heteroatoms selected from N, O, and S. A heteroaryl or heterocycloalkyl may be a monocycle having 3 to 7 ring members (for example, 2 to 6 carbon atoms and 1 to 3 heteroatoms selected from N, O, and S) or a bicycle having 7 to 10 ring members (for example, 4 to 9 carbon atoms and 1 to 3 heteroatoms selected from N, O, and S), for example: a bicyclo[4,5], [5,5], [5,6], or [6,6] system. Examples of heteroaryl groups include by way of example and not limitation, pyridyl, thiazolyl, tetrahydrothiophenyl, pyrimidinyl, furanyl, thienyl, pyrrolyl, pyrazolyl, imidazolyl, tetrazolyl, benzofuranyl, thianaphthalenyl, indolyl, indolenyl, quinolinyl, isoquinolinyl, benzimidazolyl, isoxazolyl, pyrazinyl, pyridazinyl, indolizinyl, isoindolyl, 3H-indolyl, 1H-indazolyl, purinyl, 4H-quinolizinyl, phthalazinyl, naphthyridinyl, quinoxalinyl, quinazolinyl, cinnolinyl, pteridinyl, 4aH-carbazolyl, carbazolyl, phenanthridinyl, acridinyl, pyrimidinyl, phenanthrolinyl, phenazinyl, phenothiazinyl, furazanyl, phenoxazinyl, isochromanyl, chromanyl, imidazolidinyl, imidazolinyl, pyrazolidinyl, pyrazolinyl, benzotriazolyl, benzisoxazolyl, and isatinoyl. Examples of heterocycloalkyls include by way of example and not limitation, dihydroypyridyl, tetrahydropyridyl (piperidyl), tetrahydrothiophenyl, piperidinyl, 4-piperidonyl, pyrrolidinyl, 2-pyrrolidonyl, tetrahydrofuranyl, tetrahydropyranyl, bis-tetrahydropyranyl, tetrahydroquinolinyl, tetrahydroisoquinolinyl, decahydroquinolinyl, octahydroisoquinolinyl, piperazinyl, quinuclidinyl, and morpholinyl. Heteroaryl and heterocycloalkyl groups can be unsubstituted or substituted.

"Substituted" as used herein and as applied to any of the above alkyl, aryl, cycloalkyl, heteroaryl, or heterocyclyl groups, means that one or more hydrogen atoms are each independently replaced with a substituent. Typical substituents include, but are not limited to, —Cl, Br, F, alkyl, —OH, —$OCH_3$, $NH_2$, —$NHCH_3$, —$N(CH_3)_2$, —CN, —NC(=O)$CH_3$, —C(=O)—, —C(=O) $NH_2$, and —C(=O)$N(CH_3)_2$. Wherever a group is described as "optionally substituted," that group can be substituted with one or more of the above substituents, independently selected for each occasion. In some embodiments, the substituent may be one or more methyl groups or one or more hydroxyl groups.

In some embodiments, the organic acid is an alkyl carboxylic acid. Non-limiting examples of alkyl carboxylic acids include formic acid, acetic acid, propionic acid, octanoic acid, nonanoic acid, decanoic acid, undecanoic acid, dodecanoic acid, stearic acid, oleic acid, linoleic acid, linolenic acid, and the like. In some embodiments, the organic acid is an alkyl sulfonic acid. Non-limiting examples of alkyl sulfonic acids include propanesulfonic acid and octanesulfonic acid.

In some embodiments, the alkyl carboxylic or sulfonic acid is substituted with one or more hydroxyl groups. Non-limiting examples include glycolic acid, 4-hydroxybutyric acid, and lactic acid.

In some embodiments, an organic acid may include more than one carboxylic acid group or more than one sulfonic acid group (e.g., two, three, or more carboxylic acid groups). Non-limiting examples include oxalic acid, fumaric acid, maleic acid, and glutaric acid. In organic acids containing multiple carboxylic acids (e.g., from two to four carboxylic acid groups), one or more of the carboxylic acid groups may be esterified. Non-limiting examples include succinic acid monoethyl ester, monomethyl fumarate, monomethyl or dimethyl citrate, and the like.

In some embodiments, the organic acid may include more than one carboxylic acid group and one or more hydroxyl groups. Non-limiting examples of such acids include tartaric acid, citric acid, and the like.

In some embodiments, the organic acid is an aryl carboxylic acid or an aryl sulfonic acid. Non-limiting examples of aryl carboxylic and sulfonic acids include benzoic acid, toluic acids, salicylic acid, benzenesulfonic acid, and p-toluenesulfonic acid.

Additional non-limiting examples of suitable organic acids include 2,2-dichloroacetic acid, 2-hydroxyethanesulfonic acid, 2-oxoglutaric acid, 4-acetamidobenzoic acid, 4-aminosalicylic acid, acetic acid, adipic acid, ascorbic acid (L), aspartic acid (L), camphoric acid (+), camphor-10-sulfonic acid (+), capric acid, caproic acid, caprylic acid, cinnamic acid, cyclamic acid, decanoic acid, dodecylsulfuric acid, ethane-1,2-disulfonic acid, ethanesulfonic acid, formic acid, fumaric acid, galactaric acid, gentisic acid, glucoheptonic acid, gluconic acid, glucuronic acid, glutamic acid, glycerophosphoric acid, glycolic acid, hippuric acid, isobutyric acid, lactobionic acid, lauric acid, malonic acid, mandelic acid, methanesulfonic acid, naphthalene-1,5-disulfonic acid, naphthalene-2-sulfonic acid, oleic acid, palmitic acid, pamoic acid, pyroglutamic acid, sebacic acid, stearic acid, and undecylenic acid.

In some embodiments, the one or more organic acids is a single organic acid. In some embodiments, the one or more organic acids is a combination of several acids, such as two, three, or more organic acids.

In some embodiments, the organic acid is citric acid, malic acid, tartaric acid, octanoic acid, benzoic acid, a toluic acid, salicylic acid, or a combination thereof. In some embodiments, the organic acid is benzoic acid. In some embodiments, the organic acid is citric acid.

In alternative embodiments, a portion, or even all, of the organic acid may be added in the form of a salt with an alkaline component, which may include, but is not limited to, nicotine. Non-limiting examples of suitable salts, e.g., for nicotine, include formate, acetate, propionate, isobutyrate, butyrate, alpha-methylbutyrate, isovalerate, beta-methylvalerate, caproate, 2-furoate, phenylacetate, heptanoate, octanoate, nonanoate, oxalate, malonate, glycolate, benzoate, tartrate, levulinate, ascorbate, fumarate, citrate, malate, lactate, aspartate, salicylate, tosylate, succinate, pyruvate, and the like. In some embodiments, the organic acid or a portion thereof may be added in the form of a salt with an alkali metal such as sodium, potassium, and the like. In organic acids having more than one acidic group (such as a di- or -tri-carboxylic acid), in some instances, one or more of these acid groups may be in the form of such a salt. Suitable non-limiting examples include monosodium citrate, disodium citrate, and the like. In some embodiments, the organic acid is a salt of citric acid, malic acid, tartaric acid, octanoic acid, benzoic acid, a toluic acid, salicylic acid, or a combination thereof. In some embodiments, the organic acid is a mono or di-ester of a di- or tri-carboxylic acid, respectively, such as a monomethyl ester of citric acid, malic acid, or tartaric acid, or a dimethyl ester of citric acid.

The amount of organic acid present in the mixture may vary. Generally, when present in the mixture, the organic acid comprises from about 0.1 to about 10% by weight of the mixture, which may be present as one or more organic acids. In some embodiments, the mixture is substantially free of organic acids. By "substantially free" of organic acids, it is meant that there is no intentionally added organic acid present (e.g., less than 0.1%, less than 0.05%, or 0%). In some embodiments, the mixture comprises about 0.1%, about 0.2%, about 0.3%, about 0.4%, about 0.5%, about 0.6%, about 0.7%, about 0.8%, about 0.9%, about 1%, about 2%, about 3%, about 4%, about 5%, about 6%, about 7%, about 8%, about 9%, or about 10% organic acid by weight. In some embodiments, the mixture comprises from about 0.1 to about 0.5% by weight of organic acid, for example, about 0.1, about 0.15, about 0.2, about 0.25, about 0.3, about 0.35, about 0.4, about 0.45, or about 0.5% by weight. In some embodiments, the mixture comprises from about 0.25 to about 0.35% by weight of organic acid, for example, from about 0.25, about 0.26, about 0.27, about 0.28, about 0.29, or about 0.3, to about 0.31, about 0.32, about 0.33, about 0.34, or about 0.35% by weight, based on the total weight of the composition. In the case where a salt of an organic acid is added, the percent by weight is calculated based on the weight of the free acid, not including any counter-ion which may be present.

When present, the quantity of acid in the mixture will vary based on the acidity and basicity of other components which may be present in the mixture (e.g., nicotine, salts, buffers, and the like). Accordingly, in some embodiments where the organic acid is present, the organic acid is provided in a quantity sufficient to provide a pH of 7.0 or below, (typically about 6.8 or below, about 6.6 or below, or about 6.5 or below) of the mixture. In certain embodiments the acid inclusion is sufficient to provide a mixture pH of from about 4.0 to about 7.0; for example, from about 4.5, about 5.0, about 5.5, or about 6.0, to about 6.5, or about 7.0. In some embodiments, the organic acid is provided in a quantity sufficient to provide a pH of the mixture of from about 5.5 to about 6.5, for example, from about 5.5, about 5.6, about 5.7, about 5.8, about 5.9, or about 6.0, to about 6.1, about 6.2, about 6.3, about 6.4, or about 6.5.

Salts

In some embodiments, the mixture may further comprise a salt (e.g., alkali metal salts), typically employed in an amount sufficient to provide desired sensory attributes to the composition. Non-limiting examples of suitable salts include sodium chloride, potassium chloride, ammonium chloride, flour salt, and the like. When present, a representative amount of salt is about 0.5 percent by weight or more, about 1.0 percent by weight or more, or at about 1.5 percent by weight or more, but will typically make up about 10 percent or less of the total weight of the composition, or about 7.5 percent or less or about 5 percent or less (e.g., about 0.5 to about 5 percent by weight).

Sweeteners

The mixture typically further comprises one or more sweeteners. The sweeteners can be any sweetener or combination of sweeteners, in natural or artificial form, or as a combination of natural and artificial sweeteners. Examples of natural sweeteners include fructose, sucrose, glucose, maltose, mannose, galactose, lactose, *stevia*, and the like. Examples of artificial sweeteners include sucralose, isomaltulose, maltodextrin, saccharin, aspartame, acesulfame K, neotame and the like. In some embodiments, the sweetener comprises a sugar alcohol. Sugar alcohols are polyols derived from monosaccharides or disaccharides that have a partially or fully hydrogenated form. Sugar alcohols have, for example, about 4 to about 20 carbon atoms and include erythritol, arabitol, ribitol, isomalt, maltitol, dulcitol, iditol, mannitol, xylitol, lactitol, sorbitol, and combinations thereof (e.g., hydrogenated starch hydrolysates). When present, a representative amount of sweetener may make up from about 0.1 to about 20 percent or more of the of the mixture by weight, for example, from about 0.1 to about 1%, from about 1 to about 5%, from about 5 to about 10%, or from about 10 to about 20% of the composition on a weight basis.

Binding Agents

A binder (or combination of binders) may be employed in certain embodiments, in amounts sufficient to provide the desired physical attributes and physical integrity to the mixture. Typical binders can be organic or inorganic, or a combination thereof. Representative binders include povidone, sodium alginate, starch-based binders, pectin, carrageenan, pullulan, zein, and the like, and combinations thereof. The amount of binder utilized in the mixture can vary, but is typically up to about 30 percent by weight, and certain embodiments are characterized by a binder content of at least about 0.1% by weight, such as about 1 to about 30% by weight or about 5 to about 10% by weight, based on the total weight of the mixture.

In certain embodiments, the binder includes a gum, for example, a natural gum. As used herein, a natural gum refers to polysaccharide materials of natural origin that is useful as a thickening or gelling agent. Representative natural gums derived from plants, which are typically water soluble to some degree, include xanthan gum, guar gum, gum arabic, ghatti gum, gum tragacanth, karaya gum, locust bean gum, gellan gum, and combinations thereof. When present, natural gum binder materials are typically present in an amount of up to about 5% by weight, for example, from about 0.1, about 0.2, about 0.3, about 0.4, about 0.5, about 0.6, about 0.7, about 0.8, about 0.9, or about 1%, to about 2, about 3, about 4, or about 5% by weight, based on the total weight of the mixture.

Humectants

In certain embodiments, one or more humectants may be employed in the mixture. Examples of humectants include, but are not limited to, glycerin, propylene glycol, and the like. Where included, the humectant is typically provided in an amount sufficient to provide desired moisture attributes to the mixture. Further, in some instances, the humectant may impart desirable flow characteristics to the mixture for depositing in a mold. When present, a humectant will typically make up about 5% or less of the weight of the mixture (e.g., from about 0.5 to about 5%). When present, a representative amount of humectant is about 0.1% to about 1% by weight, or about 1% to about 5% by weight, based on the total weight of the mixture.

Buffering Agents

In certain embodiments, the mixture of the present disclosure can comprise pH adjusters or buffering agents. Examples of pH adjusters and buffering agents that can be used include, but are not limited to, metal hydroxides (e.g., alkali metal hydroxides such as sodium hydroxide and potassium hydroxide), and other alkali metal buffers such as metal carbonates (e.g., potassium carbonate or sodium carbonate), or metal bicarbonates such as sodium bicarbonate, and the like. Where present, the buffering agent is typically present in an amount less than about 5 percent based on the weight of the formulation, for example, from about 0.5% to about 5%, such as, e.g., from about 0.75% to about 4%, from about 0.75% to about 3%, or from about 1% to about 2% by weight, based on the total weight of the mixture. Non-limiting examples of suitable buffers include alkali metals acetates, glycinates, phosphates, glycerophosphates, citrates, carbonates, hydrogen carbonates, borates, or mixtures thereof.

Colorants

A colorant may be employed in amounts sufficient to provide the desired physical attributes to the mixture. Examples of colorants include various dyes and pigments, such as caramel coloring and titanium dioxide. The amount of colorant utilized in the mixture can vary, but when present is typically up to about 3 dry weight percent, such as from about 0.1%, about 0.5%, or about 1%, to about 3% by weight, based on the total weight of the mixture.

Active Ingredient

The mixture may additionally or alternatively include active ingredients including, but not limited to, nicotine, botanical ingredients (e.g., lavender, peppermint, chamomile, basil, rosemary, ginger, *cannabis, ginseng*, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C, and/or cannabinoids, such as tetrahydrocannabinol (THC) and cannabidiol (CBD)). The particular percentages and choice of ingredients will vary depending upon the desired flavor, texture, and other characteristics.

In certain embodiments, a nicotine component may be included in the mixture. By "nicotine component" is meant any suitable form of nicotine (e.g., free base or salt) for providing oral absorption of at least a portion of the nicotine present. Typically, the nicotine component is selected from the group consisting of nicotine free base and a nicotine salt. In some embodiments, nicotine is in its free base form, which easily can be adsorbed in for example, a microcrystalline cellulose material to form a microcrystalline cellulose-nicotine carrier complex. See, for example, the discussion of nicotine in free base form in US Pat. Pub. No. 2004/0191322 to Hansson, which is incorporated herein by reference.

In some embodiments, at least a portion of the nicotine can be employed in the form of a salt. Salts of nicotine can be provided using the types of ingredients and techniques set forth in U.S. Pat. No. 2,033,909 to Cox et al. and Perfetti, *Beitrage Tabakforschung Int.,* 12:43-54 (1983), which are incorporated herein by reference. Additionally, salts of nicotine are available from sources such as Pfaltz and Bauer, Inc. and K&K Laboratories, Division of ICN Biochemicals, Inc. Typically, the nicotine component is selected from the group consisting of nicotine free base, a nicotine salt such as hydrochloride, dihydrochloride, monotartrate, bitartrate, sulfate, salicylate, and nicotine zinc chloride. In some embodiments, the nicotine component or a protion thereof is a nicotine salt with at least a portion of the one or more organic acids as disclosed herein above.

In some embodiments, at least a portion of the nicotine can be in the form of a resin complex of nicotine, where nicotine is bound in an ion-exchange resin, such as nicotine polacrilex, which is nicotine bound to, for example, a polymethacrilic acid such as a polymethacrilic acid available under the tradenames Amberlite® (DDP SPECIALTY ELECTRONIC MATERIALS US), Purolite® (Brotech Corp. Delaware, USA), or Doshion® (Doshion Poly Science Pvt. Ltd., India). Suitable polymethacrilic acids include the H-form polacrilex resins Amberlite® IRP64, Purolite® C115HMR, or Doshion® P551. See, for example, U.S. Pat. No. 3,901,248 to Lichtneckert et al., which is incorporated herein by reference. Another example is a nicotine-polyacrylic carbomer complex, such as with Carbopol® 974P (carboxypolymethylene carbomer; Lubrizol Pharmaceuticals, Ohio, USA). In some embodiments, nicotine may be present in the form of a nicotine polyacrylic complex.

Typically, the nicotine component (calculated as the free base) when present, is in a concentration of at least about 0.001% by weight of the mixture, such as in a range from about 0.001% to about 10%. In some embodiments, the nicotine component is present in a concentration from about 0.1% w/w to about 10% by weight, such as, e.g., from about from about 0.1% w/w, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, or about 10% by weight, calculated as the free base and based on the total weight of the mixture. In some embodiments, the nicotine component is present in a concentration from about 0.1% w/w to about 3% by weight, such as, e.g., from about from about 0.1% w/w to about 2.5%, from about 0.1% to about 2.0%, from about 0.1% to about 1.5%, or from about 0.1% to about 1% by weight, calculated as the free base and based on the total weight of the mixture. These ranges can also apply to other active ingredients noted herein.

Tobacco Material

In some embodiments, the mixture may include a tobacco material. The tobacco material can vary in species, type, and form. Generally, the tobacco material is obtained from for a harvested plant of the *Nicotiana* species. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N. x sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. Hersperis, *N. pauciflora, N. petunioides, N. quadrivalvis, N. repanda, N. rotundifolia, N. solanifolia*, and *N. spegazzinii*. Various representative other types of plants from the *Nicotiana* species are set forth in Goodspeed, The Genus *Nicotiana*, (Chonica Botanica) (1954); U.S. Pat. No. 4,660,577 to Sensabaugh, Jr. et al.; U.S. Pat. No. 5,387,416 to White et al., U.S. Pat. No. 7,025,066 to Lawson et al.; U.S. Pat. No. 7,798,153 to Lawrence, Jr. and U.S. Pat. No. 8,186,360 to Marshall et al.; each of which is incorporated herein by reference. Descriptions of various types of tobaccos, growing practices and harvesting practices are set forth in *Tobacco Production, Chemistry and Technology*, Davis et al. (Eds.) (1999), which is incorporated herein by reference.

*Nicotiana* species from which suitable tobacco materials can be obtained can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference.

The *Nicotiana* species can, in some embodiments, be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., Galpao *commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be included within a mixture as disclosed herein. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material comprises tobacco leaf (lamina). The mixture disclosed herein can include processed tobacco parts or pieces, cured and aged tobacco in essentially natural lamina and/or stem form, a tobacco extract, extracted tobacco pulp (e.g., using water as a solvent), or a mixture of the foregoing (e.g., a mixture that combines extracted tobacco pulp with granulated cured and aged natural tobacco lamina).

In certain embodiments, the tobacco material comprises solid tobacco material selected from the group consisting of lamina and stems. The tobacco that is used for the mixture most preferably includes tobacco lamina, or a tobacco lamina and stem mixture (of which at least a portion is smoke-treated). Portions of the tobaccos within the mixture may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the mixture optionally may incorporate tobacco that has been fermented. See, also, the types of tobacco processing techniques set forth in PCT WO2005/063060 to Atchley et al., which is incorporated herein by reference.

The tobacco material is typically used in a form that can be described as particulate (i.e., shredded, ground, granulated, or powder form). The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. For example, tobacco parts or pieces may be ground or milled when the moisture content thereof is less than about 15 weight percent or less than about 5 weight percent. Most preferably, the tobacco material is employed in the form of parts or pieces that have an average particle size between 1.4 millimeters and 250 microns. In some instances, the tobacco particles may be sized to pass through a screen mesh to obtain the particle size range required. If desired, air classification equipment may be used to ensure that small sized tobacco particles of the desired sizes, or range of sizes, may be collected. If desired, differently sized pieces of granulated tobacco may be mixed together.

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. For example, the tobacco plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25 weight percent, often less than about 20 weight percent, and frequently less than about 15 weight percent.

For the preparation of oral products, it is typical for a harvested plant of the *Nicotiana* species to be subjected to a curing process. The tobacco materials incorporated within the mixtures for inclusion within pouched products as disclosed herein are those that have been appropriately cured and/or aged. Descriptions of various types of curing processes for various types of tobaccos are set forth in *Tobacco Production, Chemistry and Technology*, Davis et al. (Eds.) (1999). Examples of techniques and conditions for curing flue-cured tobacco are set forth in Nestor et al., *Beitrage Tabakforsch. Int.,* 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.,* 21, 305-320 (2005) and Staaf et al., *Beitrage Tabakforsch. Int.,* 21, 321-330 (2005), which are incorporated herein by reference. Certain types of tobaccos can be subjected to alternative types of curing processes, such as fire curing or sun curing.

In certain embodiments, tobacco materials that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Madole, Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos and various blends of any of the foregoing tobaccos.

The tobacco material may also have a so-called "blended" form. For example, the tobacco material may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other example tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other example tobacco blends incorporate about 20 to about 30 parts Oriental tobacco and about 70 to about 80 parts flue-cured tobacco.

Tobacco materials used in the present disclosure can be subjected to, for example, fermentation, bleaching, and the like. If desired, the tobacco materials can be, for example, irradiated, pasteurized, or otherwise subjected to controlled heat treatment. Such treatment processes are detailed, for example, in U.S. Pat. No. 8,061,362 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, cysteine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof. See, for example, the types of treatment processes described in U.S. Pat. Nos. 8,434,496, 8,944,072, and 8,991,403 to Chen et al., which are all incorporated herein by reference. In certain embodiments, this type of treatment is useful where the original tobacco material is subjected to heat in the processes previously described.

In some embodiments, the type of tobacco material is selected such that it is initially visually lighter in color than other tobacco materials to some degree (e.g., whitened or bleached). Tobacco pulp can be whitened in certain embodiments according to any means known in the art, For example, bleached tobacco material produced by various whitening methods using various bleaching or oxidizing agents and oxidation catalysts can be used. Example oxidizing agents include peroxides (e.g., hydrogen peroxide), chlorite salts, chlorate salts, perchlorate salts, hypochlorite salts, ozone, ammonia, and combinations thereof. Example oxidation catalysts are titanium dioxide, manganese dioxide, and combinations thereof. Processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 3,943,945 to Rosen; U.S. Pat. No. 4,143,666 to Rainer; U.S. Pat. No. 4,194,514 to Campbell; U.S. Pat. Nos. 4,366,823, 4,366,824, and 4,388,933 to Rainer et al.; U.S. Pat. No. 4,641,667 to Schmekel et al.; and U.S. Pat. No. 5,713,376 to Berger; and PCT WO 96/31255 to Giolvas, all of which are incorporated herein by reference. Other whitening methods using reagents such as ozone and potassium permanganate can also be used. See, for example, U.S. Pat. No. 3,943,940 to Minami, which is incorporated herein by reference.

In some embodiments, the whitened tobacco material can have an ISO brightness of at least about 50%, at least about 60%, at least about 65%, at least about 70%, at least about 75%, or at least about 80%. In some embodiments, the whitened tobacco material can have an ISO brightness in the range of about 50% to about 90%, about 55% to about 75%, or about 60% to about 70%. ISO brightness can be measured according to ISO 3688:1999 or ISO 2470-1:2016.

In some embodiments, the whitened tobacco material can be characterized as lightened in color (e.g., "whitened") in comparison to an untreated tobacco material. White colors are often defined with reference to the International Commission on Illumination's (CIE's) chromaticity diagram. The whitened tobacco material can, in certain embodiments, be characterized as closer on the chromaticity diagram to pure white than an untreated tobacco material.

In various embodiments, the tobacco material can be treated to extract a soluble component of the tobacco material therefrom. "Tobacco extract" as used herein refers to the isolated components of a tobacco material that are extracted from solid tobacco pulp by a solvent that is brought into contact with the tobacco material in an extraction process. Various extraction techniques of tobacco materials can be used to provide a tobacco extract and tobacco solid material. See, for example, the extraction processes described in US Pat. Appl. Pub. No. 2011/0247640 to Beeson et al., which is incorporated herein by reference. Other example techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

Typical inclusion ranges for tobacco materials can vary depending on the nature and type of the tobacco material, and the intended effect on the final composition, with an example range of up to about 30% by weight, based on total weight of the mixtures (e.g., about 0.1 to about 15% by weight). In some embodiments, the products of the disclosure can be characterized as completely free or substantially free of tobacco material (other than purified nicotine as an active ingredient). For example, certain embodiments can be characterized as having less than 1% by weight, or less than 0.5% by weight, or less than 0.1% by weight of tobacco material, or 0% by weight of tobacco material. In some embodiments, the mixture comprises tobacco. In some embodiments, the mixture comprises up to about 5% of tobacco, for example, from about 0.1 to about 1%, or from about 1% to about 5% by weight of tobacco, based on the total weight of the mixture. In some embodiments, the mixture comprises a traditional tobacco or a white tobacco. In some embodiments, the tobacco is a white tobacco.

Other Additives

Other additives can be included in the disclosed mixture. For example, the mixture can be processed, blended, formulated, combined and/or mixed with other materials or ingredients. The additives can be artificial, or can be obtained or derived from herbal or biological sources. Examples of types of additives include gelling agents (e.g., fish gelatin), emulsifiers, oral care additives (e.g., thyme oil, *eucalyptus* oil, and zinc), preservatives (e.g., potassium sorbate and the like), antioxidants, disintegration aids, or combinations thereof. See, for example, those representative components, combination of components, relative amounts of those components, and manners and methods for employing those components, set forth in U.S. Pat. No. 9,237,769 to Mua et al., U.S. Pat. No. 7,861,728 to Holton, Jr. et al., U.S. Pat. App. Pub. No. 2010/0291245 to Gao et al., and U.S. Pat. App. Pub. No. 2007/0062549 to Holton, Jr. et al., each of which is incorporated herein by reference. These and other exemplary types of additives may include those described in, for example, previously incorporated by reference herein. Typical inclusion ranges for such additional additives can vary depending on the nature and function of the additive and the intended effect on the final composition, with an example range of up to about 10% by weight, based on total weight of the mixture (e.g., about 0.1 to about 5% by weight).

The aforementioned additives can be employed together (e.g., as additive formulations) or separately (e.g., individual additive components can be added at different stages involved in the preparation of the final mixture). Furthermore, the aforementioned types of additives may be encapsulated as provided in the final product or mixture. Exemplary encapsulated additives are described, for example, in WO 2010/132444 A2 to Atchley, which has been previously incorporated by reference herein.

In some embodiments, any one or more of a filler component, a tobacco material, and the overall oral product described herein can be described as a particulate material. As used herein, the term "particulate" refers to a material in the form of a plurality of individual particles, some of which can be in the form of an agglomerate of multiple particles, wherein the particles have an average length to width ratio less than 2:1, such as less than 1.5:1, such as about 1:1. In various embodiments, the particles of a particulate material can be described as substantially spherical or granular.

The particle size of a particulate material may be measured by sieve analysis. As the skilled person will readily appreciate, sieve analysis (otherwise known as a gradation test) is a method used to measure the particle size distribution of a particulate material. Typically, sieve analysis involves a nested column of sieves which comprise screens, preferably in the form of wire mesh cloths. A pre-weighed sample may be introduced into the top or uppermost sieve in the column, which has the largest screen openings or mesh size (i.e. the largest pore diameter of the sieve). Each lower sieve in the column has progressively smaller screen openings or mesh sizes than the sieve above. Typically, at the base of the column of sieves is a receiver portion to collect any particles having a particle size smaller than the screen opening size or mesh size of the bottom or lowermost sieve in the column (which has the smallest screen opening or mesh size).

In some embodiments, the column of sieves may be placed on or in a mechanical agitator. The agitator causes the vibration of each of the sieves in the column. The mechanical agitator may be activated for a pre-determined period of time in order to ensure that all particles are collected in the correct sieve. In some embodiments, the column of sieves is agitated for a period of time from 0.5 minutes to 10 minutes, such as from 1 minute to 10 minutes, such as from 1 minute to 5 minutes, such as for approximately 3 minutes. Once the agitation of the sieves in the column is complete, the material collected on each sieve is weighed. The weight of each sample on each sieve may then be divided by the total weight in order to obtain a percentage of the mass retained on each sieve. As the skilled person will readily appreciate, the screen opening sizes or mesh sizes for each sieve in the column used for sieve analysis may be selected based on the granularity or known maximum/minimum particle sizes of the sample to be analysed. In some embodiments, a column of sieves may be used for sieve analysis, wherein the column comprises from 2 to 20 sieves, such as from 5 to 15 sieves. In some embodiments, a column of sieves may be used for sieve analysis, wherein the column comprises 10 sieves. In some embodiments, the largest screen opening or mesh sizes of the sieves used for sieve analysis may be 1000 μm, such as 500 μm, such as 400 μm, such as 300 μm.

In some embodiments, any particulate material referenced herein (e.g., filler component, tobacco material, and the overall oral product) can be characterized as having at least 50% by weight of particles with a particle size as measured by sieve analysis of no greater than about 1000 μm, such as no greater than about 500 μm, such as no greater than about 400 μm, such as no greater than about 350 μm, such as no greater than about 300 μm. In some embodiments, at least 60% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 70% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 80% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 90% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 95% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 99% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm. In some embodiments, approximately 100% by weight of the particles of any particulate material referenced herein have a particle size as measured by sieve analysis of no greater than about 1000 μm, such as no greater than about 500 μm, such as no greater than about 400 μm, such as no greater than about 350 μm, such as no greater than about 300 μm.

In some embodiments, at least 50% by weight, such as at least 60% by weight, such as at least 70% by weight, such as at least 80% by weight, such as at least 90% by weight, such as at least 95% by weight, such as at least 99% by weight of the particles of any particulate material referenced herein have a particle size as measured by sieve analysis of from about 0.01 μm to about 1000 μm, such as from about 0.05 μm to about 750 μm, such as from about 0.1 μm to about 500 μm, such as from about 0.25 μm to about 500 μm. In some embodiments, at least 50% by weight, such as at least 60% by weight, such as at least 70% by weight, such as at least 80% by weight, such as at least 90% by weight, such as at least 95% by weight, such as at least 99% by weight of the particles of any particulate material referenced herein have a particle size as measured by sieve analysis of from about 10 μm to about 400 μm, such as from about 50 μm to about 350 μm, such as from about 100 μm to about 350 μm, such as from about 200 μm to about 300 μm.

Preparation of Mixtures

The manner by which the various components of the mixture are combined may vary. As such, the overall mixture of various components with e.g., powdered mixtures components may be relatively uniform in nature. The components noted above, which may be in liquid or dry solid form, can be admixed in a pretreatment step prior to mixing with any remaining components of the mixture, or simply mixed together with all other liquid or dry ingredients. The various components of the mixture may be contacted, combined, or mixed together using any mixing technique or equipment known in the art. Any mixing method that brings the mixture ingredients into intimate contact can be used, such as a mixing apparatus featuring an impeller or other structure capable of agitation. Examples of mixing equipment include casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, Hobart mixers, and the like. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. In some embodiments, the components forming the mixture are prepared such that the mixture thereof may be used in a starch molding process for forming the mixture. Manners and methods for formulating mixtures will be apparent to those skilled in the art. See, for example, the types of methodologies set forth in U.S. Pat. No. 4,148,325 to Solomon et al.; U.S. Pat. No. 6,510,855 to Korte et al.; and U.S. Pat. No. 6,834,654 to Williams, U.S. Pat. No. 4,725,440 to Ridgway et al., and U.S. Pat. No. 6,077,524 to Bolder et al., each of which is incorporated herein by reference.

In certain embodiments, products of the present disclosure are prepared by i) mixing one or more flavoring agents with a cellulose derivative to form a first mixture; and ii) mixing the first mixture with a particulate filler component and water to form a second mixture. Without wishing to be bound by any particular theory, it is believed that certain volatile components in the flavoring agent (e.g., esters, terpenes, and the like) may interact with or in some manner form a complex with the cellulose derivative, which serves to stabilize the resulting second mixture with regard to retention of the referenced volatile components.

Configured for Oral Use

Provided herein is a product configured for oral use. The term "configured for oral use" as used herein means that the product is provided in a form such that during use, saliva in the mouth of the user causes one or more of the components of the mixture (e.g., flavoring agents and/or nicotine) to pass into the mouth of the user. In certain embodiments, the product is adapted to deliver components to a user through mucous membranes in the user's mouth and, in some instances, said component is an active ingredient (including, but not limited to, for example, nicotine) that can be absorbed through the mucous membranes in the mouth when the product is used. In some embodiments, the component is a taste substance (i.e., a volatile flavor component).

Products configured for oral use as described herein may take various forms, including gels, pastilles, gums, lozenges, powders, and pouches. Gels can be soft or hard. Certain products configured for oral use are in the form of pastilles. As used herein, the term "pastille" refers to a dissolvable oral product made by solidifying a liquid or gel composition so that the final product is a somewhat hardened solid gel. The rigidity of the gel is highly variable. Certain products of the disclosure are in the form of solids. Certain products can exhibit, for example, one or more of the following characteristics: crispy, granular, chewy, syrupy, pasty, fluffy, smooth, and/or creamy. In certain embodiments, the desired textural property can be selected from the group consisting of adhesiveness, cohesiveness, density, dryness, fracturability, graininess, gumminess, hardness, heaviness, moisture absorption, moisture release, mouthcoating, roughness, slipperiness, smoothness, viscosity, wetness, and combinations thereof.

The products comprising the mixture of the present disclosure may be dissolvable. As used herein, the terms "dissolve," "dissolving," and "dissolvable" refer to compositions having aqueous-soluble components that interact with moisture in the oral cavity and enter into solution, thereby causing gradual consumption of the product. According to one aspect, the dissolvable product is capable of lasting in the user's mouth for a given period of time until it completely dissolves. Dissolution rates can vary over a wide range, from about 1 minute or less to about 60 minutes. For example, fast release compositions typically dissolve and/or release the active substance in about 2 minutes or less, often about 1 minute or less (e.g., about 50 seconds or less, about 40 seconds or less, about 30 seconds or less, or about 20 seconds or less). Dissolution can occur by any means, such as melting, mechanical disruption (e.g., chewing), enzymatic or other chemical degradation, or by disruption of the interaction between the components of the mixture. In some embodiments, the product can be meltable as discussed, for example, in US Patent App. Pub. No. 20120037175 to Cantrell et al. In other embodiments, the products do not dissolve during the product's residence in the user's mouth.

In one embodiment, the product comprising the mixture of the present disclosure is in the form of a mixture disposed within a moisture-permeable container (e.g., a water-permeable pouch). Such mixtures in the water-permeable pouch format are typically used by placing one pouch containing the mixture in the mouth of a human subject/user. Generally, the pouch is placed somewhere in the oral cavity of the user, for example under the lips, in the same way as moist snuff products are generally used. The pouch preferably is not chewed or swallowed. Exposure to saliva then causes some of the components of the mixture therein (e.g., flavoring agents and/or nicotine) to pass through e.g., the water-permeable pouch and provide the user with flavor and satisfaction, and the user is not required to spit out any portion of the mixture. After about 10 minutes to about 60 minutes, typically about 15 minutes to about 45 minutes, of use/enjoyment, substantial amounts of the mixture have been ingested by the human subject, and the pouch may be removed from the mouth of the human subject for disposal.

Accordingly, in certain embodiments, the mixture as disclosed herein and any other components noted above are combined within a moisture-permeable packet or pouch that acts as a container for use of the mixture to provide a pouched product configured for oral use. Certain embodiments of the disclosure will be described with reference to the accompanying drawing, and these described embodiments involve snus-type products having an outer pouch and containing a mixture as described herein. As explained in greater detail below, such embodiments are provided by way of example only, and the pouched products of the present disclosure can include mixture in other forms. The composition/construction of such packets or pouches, such as the container pouch 102 in the embodiment illustrated in the drawing, may be varied. Referring to the drawing, there is shown a first embodiment of a pouched product 100. The pouched product 100 includes a moisture-permeable container in the form of a pouch 102, which contains a material 104 comprising a mixture as described herein.

Suitable packets, pouches or containers of the type used for the manufacture of smokeless tobacco products are available under the tradenames CatchDry (Swedish Match), Ettan (Swedish Match), General (Swedish Match), Granit (Fiedler & Lundgren), Goteborgs Rapé (Swedish Match), Grovsnus White (Swedish Match), Metropol Kaktus (Fiedler & Lundgren), Mocca (Anis, Mint, Wintergreen; Fiedler & Lundgren), Kicks, Probe (Swedish Match), Prince (British American Tobacco), Skruf (Skruf Snus AB) and Tre Ankrare (Swedish Match). The mixture may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the mixture readily diffuse through the pouch and into the mouth of the user.

Non-limiting examples of suitable types of pouches are set forth in, for example, U.S. Pat. No. 5,167,244 to Kjerstad, which is incorporated herein by reference. Pouches can be provided as individual pouches, or a plurality of pouches (e.g., 2, 4, 5, 10, 12, 15, 20, 25 or 30 pouches) can be connected or linked together (e.g., in an end-to-end manner) such that a single pouch or individual portion can be readily removed for use from a one-piece strand or matrix of pouches.

An example pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and mixture each may undergo complete dispersion within the mouth of the user during normal conditions of use, and hence the pouch and mixture both may be ingested by the user. Other examples of pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the mixture contents permeate through the pouch material prior to the time that the pouch undergoes loss of its physical integrity. If desired, flavoring ingredients, disintegration aids, and other desired components, may be incorporated within, or applied to, the pouch material.

The amount of material contained within each product unit, for example, a pouch, may vary. In some embodiments, the dry weight of the mixture within each pouch is at least about 50 mg, for example, from about 50 mg to about 1 gram, from about 100 to 800 about mg, or from about 200 to about 700 mg. In some smaller embodiments, the dry weight of the mixture within each pouch may be from about 100 to about 300 mg. For a larger embodiment, the dry weight of the material within each pouch may be from about 300 mg to about 700 mg. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

A pouched product as described herein can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 8,397,945 to Gelardi et al., D592,956 to Thiellier; D594,154 to Patel et al.; and D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; and 2011/0168712 to Bailey et al. which are incorporated herein by reference.

Storage and Storage Period

Products of the present disclosure configured for oral use may be packaged and stored in any suitable packaging in much the same manner that conventional types of smokeless tobacco products are packaged and stored. For example, a plurality of packets or pouches may be contained in a cylindrical container. The storage period of the product after preparation may vary. As used herein, "storage period" refers to the period of time after the preparation of the disclosed product. In some embodiments, one or more of the characteristics of the products disclosed herein (e.g., retention of volatile flavor components) is exhibited over some or all of the storage period. In some embodiments, the storage period (i.e., the time period after preparation) is at least one day. In some embodiments, the storage period is from about about 1 day, about 2 days, or about 3 days, to about 1 week, or from about 1 week to about 2 weeks, from about 2 weeks to about 1 month, from about 1 month to about 2 months, from about 2 months to about 3 months, from about 3 month to about 4 months, or from about 4 months to about 5 months. In some embodiments, the storage period is any number of days between about 1 and about 150. In certain embodiments, the storage period may be longer than 5 months, for example, about 6 months, about 7 months, about 8 months, about 9 months, about 10 months, about 11 months, or about 12 months.

In some embodiments, the product as disclosed herein has a concentration of one or more of the at least one volatile flavor components present, which is greater than a concentration of the same one or more volatile flavor components present in a control product which does not include the cellulose derivative, as determined by semi-quantitative Gas Chromatography-Mass Spectrometry, when measured at a time point over the disclosed storage period.

Method of Stabilizing Product Configured for Oral Use

In another aspect is provided a method of stabilizing a product configured for oral use, the stabilized product comprising a mixture as disclosed herein. The process comprises i) mixing one or more flavoring agents comprising at least one volatile flavor component with a cellulose derivative to form a first mixture; and ii) mixing the first mixture with a filler component and water to form a second mixture.

In some embodiments, the method further comprises adding one or more salts, one or more sweeteners, one or more binding agents, one or more humectants, one or more gums, one or more active ingredients, a tobacco material, or combinations thereof, to the mixture of step ii). In some embodiments, the method further comprises adding one or more active ingredients selected from the group consisting of a nicotine component, botanicals, stimulants, amino acids, vitamins, and cannabinoids. In some embodiments, the method further comprises adding from about 0.001 to about 10% by weight of a nicotine component. In some embodiments, the method further comprises adding from about 0.1 to about 0.5% by weight of one or more organic acids.

In some embodiments, the method further comprises providing the mixture in a pouch.

In some embodiments, the product prepared according to the disclosed method, when measured at a time period of 1 day after preparation, has a concentration of one or more of the at least one volatile flavor components present which is greater than a concentration of the same one or more volatile flavor components present in a control product which does not include the first filler component, as determined by semi-quantitative Gas Chromatography-Mass Spectrometry. In some embodiments, the time period is one or more of 2 days, 1 week, 2 weeks, 3 weeks, or 1 month after preparation.

In some embodiments, the concentration is greater than the concentration of the same one or more volatile flavor components present in the product at a time period of 2 days, 3 days, 1 week, 2 weeks, 1 month, 2 months, 3 months, 4 months, or 5 months after preparation. In some embodiments, the concentration is greater than the concentration of the same one or more volatile flavor components present in the control product at a time period of 6 months, 7 months, 8 months, 9 months, 10 months, 11 months, or 12 months after preparation.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

Experimental

Aspects of the present invention are more fully illustrated by the following examples, which are set forth to illustrate certain aspects of the present invention and are not to be construed as limiting thereof.

General Analytical Methods

Methanol (MeOH) was purchased from Sigma-Aldrich (St. Louis, MO, USA). Flavor standards were obtained from the R.J. Reynolds Flavor Laboratory.

Semi-Quantitation of Flavors

The relative amounts of various flavors were quantitatively assessed using gas chromatography/mass spectrometry (GC-MS) with Single Ion Monitoring (SIM) chromatograms against a calibration curve. The instrument used for quantitation was an Agilent (Wilmington, DE, USA) 6890N/5973 GC-MS. The data analysis was done using MassHunter Quantitative Analysis 8.07.00. Detailed parameters are listed in Table 1.

Each sample was accurately weighed into a scintillation vial on an analytical balance for a target weight of 0.5 grams. Each sample was then diluted with 5 mL isopropanol (containing 5.9 μg/mL $d^7$-quinoline as the internal standard) and placed on an orbital shaker for 3 hours at 200 RPM. After shaking, each sample was filtered through a 0.45 μm PVDF filter and transferred to a GC sample vial for analysis. Each sample was prepared in duplicate and analyzed by GC-MS.

Each compound was semi-quantitated using the amount of internal standard divided by the internal standard peak area as a conversion factor (Compound Peak Area×μg Internal Standard/Internal Standard Area=μg Compound). It should be noted that relative extraction efficiencies and relative response factors were not taken into consideration.

TABLE 1

GC-MS Operating Conditions

| Parameter | Setting | Parameter | Setting |
|---|---|---|---|
| GC Parameters (Agilent 7890B) | | Oven Program | |
| Column Phase | DB-WAXETR | Initial Temperature | 37° C. |
| Length | 30 m | Initial Time | 2 min |
| Internal Diameter | 0.25 mm | Rate 1 | 2.5° C./min |
| Film Thickness | 0.25 pm | Final Temperature | 230° C. |
| Flow Mode | Constant Flow | Final Time | 25.8 min |
| Flow Rate | 1.5 mL/min | Run Time | 105 min |
| Inlet Mode | Splitless | | |
| Purge Flow | 50 mL/min | | |
| Purge Time | 0.75 min | | |
| Gas Saver | On | | |
| Gas Saver Flow | 20 mL/min | | |
| Gas Saver Time | 3 min | | |
| Gas Type | Helium | | |
| Inlet Temperature | 250° C. | | |
| Injection Volume | 1 pl | | |
| MS Parameters (Agilent 5977A) | | | |
| Solvent Delay | 7 min | MS acquisition mode | SCAN |
| Transfer Line | 250° C. | Mass range | 15-550 amu |
| MS Source Temperature | 230° C. | Threshold | 150 |
| MS Quad Temperature | 150° C. | Sampling Rate | 2 |

Example 1. Tropical Flavor Embodiment (Comparative

A comparative control pouched product was prepared comprising a base formulation of 43% microcrystalline cellulose (mcc) and 41% water, each by weight of the mixture, and additional components as disclosed herein (salt, binder, sweetener, humectant, tropical flavor package, and 4 mg nicotine). To prepare the mixture, a portion of the water was added to the mcc, and the other components were mixed and added to the mcc solution.

Example 2. Tropical Flavor Embodiment (Inventive

A pouched product according to one embodiment was prepared comprising a base formulation as in Example 1, but substituting 3% by weight hydroxypropylcellulose (HPC) for a portion of the mcc (3% HPC, 40% mcc and 41% water; each by weight of the mixture). To prepare the mixture, a portion of the water was added to the mcc. Separately, the tropical flavor package was added to the HPC. The remaining components were added to the mcc solution and mixed, followed lastly by addition of the flavor/HPC mixture.

Example 3. Tropical Flavor Embodiment (Inventive

A pouched product according to one embodiment was prepared comprising a base formulation as in Example 1, but substituting 2% by weight HPC for a portion of the mcc (2% HPC, 41% mcc and 41% water; each by weight of the mixture). To prepare the mixture, a portion of the water was added to the mcc. Separately, the tropical flavor package was added to the HPC. The remaining components were added to the mcc solution and mixed, followed lastly by addition of the flavor/HPC mixture.

Example 4. Semi-Quantitation of Tropical Flavor Components, 0 vs. 3% HPC

Samples of the products prepared in Examples 1 and 2 were evaluated semi-quantitatively for various flavor components present in the tropical flavor package at 1 day after preparation. Results are shown in Table 2. These results demonstrate the surprising finding that certain volatile flavor components are better retained in formulations which include HPC relative to those containing only mcc filler.

TABLE 2

Semi-Quantitation of Tropical Flavor Components

| RT, min. | Component | Example 1 (Comparative) μg/g | Example 2 (Inventive, 3% HPC) μg/g |
|---|---|---|---|
| 8.69 | Isoamyl acetate | NA | 1.8 |
| 12.42 | Ethyl hexanoate | NA | 7.5 |
| 14.74 | 2-Propanone, 1-hydroxy- | 2.9 | 2.5 |
| 16.50 | Ethyl heptanooate | 2.4 | 64.2 |
| 18.21 | Allyl hexanoate | NA | 21.7 |
| 38.14 | 2-Cyclopenten-1-one, 2-hydroxy-3-methyl | 2.4 | 5.2 |

Example 5. Semi-Quantitation of Tropical Flavor Components, 2% HPC

A sample of the product prepared in Example 3 was evaluated semi-quantitatively for various flavor components present in the tropical flavor package at various time points after preparation (1 day, 1 week, 2 weeks, 3 weeks, and 4 weeks; $T_1$-$T_5$, respectively). Results are shown in Table 3. Referring to Table 3, the mixture of Example 3, containing 2% HPC in the base material, retained readily detectable quantities of ethyl hexanoate, ethyl heptanooate, and allyl hexanoate over the study period.

TABLE 3

Semi-Quantitation of Tropical Flavor Components, 2% HPC, timecourse study

| RT, min. | Name | $T_1$ (μg/g) | $T_2$ (μg/g) | $T_3$ (μg/g) | $T_4$ (μg/g) | $T_5$ (μg/g) |
|---|---|---|---|---|---|---|
| 8.605 | Isoamyl acetate | 1.1 | NA | NA | NA | NA |
| 12.33 | Ethyl hexanoate | 30.2 | 12.6 | 8.3 | 5.2 | 5.0 |
| 14.68 | 2-Propanone, 1-hydroxy- | 1.3 | 2.1 | 1.6 | 1.2 | 2.1 |
| 16.43 | Ethyl heptanooate | 33.7 | 16.9 | 10.2 | 7.6 | 6.9 |
| 18.15 | Allyl hexanoate | 11.7 | 6.9 | 4.1 | 3.1 | 3.2 |
| 38.09 | 2-Cyclopenten-1-one, 2-hydroxy-3-methyl | 8.2 | 3.4 | 0.7 | NA | NA |

Example 6. Semi-Quantitation of Tropical Flavor Components, 3% HPC

A sample of the product prepared in Example 2 was evaluated semi-quantitatively for various flavor components present in the tropical flavor package at various time points after preparation (1 day, 1 week, 2 weeks, 3 weeks, and 4 weeks; $T_1$-$T_5$, respectively). Results are shown in Table 4. Referring to Table 4, the mixture of Example 2, containing 3% HPC in the base material, had an average of approximately 50% higher concentration of total flavor components across all time points when compared to the mixture of Example 3 (Table 3), containing 2% HPC in the base material.

TABLE 4

Semi-Quantitation of Tropical Flavor Components, 3% HPC, timecourse study

| RT, min. | Name | $T_1$ (μg/g) | $T_2$ (μg/g) | $T_3$ (μg/g) | $T_4$ (μg/g) | $T_5$ (μg/g) |
|---|---|---|---|---|---|---|
| 8.605 | Isoamyl acetate | 2.3 | 0.9 | NA | NA | NA |
| 12.33 | Ethyl hexanoate | 54.6 | 22.2 | 15.3 | 9.8 | 8.8 |
| 14.68 | 2-Propanone, 1-hydroxy- | 1.3 | 1.7 | 1.3 | 1.2 | 2.4 |
| 16.43 | Ethyl heptanooate | 50.0 | 22.4 | 15.4 | 10.8 | 9.8 |
| 18.15 | Allyl hexanoate | 17.3 | 9.1 | 6.0 | 4.4 | 4.3 |
| 38.09 | 2-Cyclopenten-1-one, 2-hydroxy-3-methyl | 8.3 | 4.5 | 0.8 | NA | NA |

What is claimed is:

1. A product configured for oral use, the product comprising a mixture comprising:

from about 10 to about 60% by weight of microcrystalline cellulose;

from about 1 to about 5% by weight of a cellulose derivative selected from the group consisting of methylcellulose, hydroxyethyl cellulose, hydroxypropylcellulose (HPC), hydroxypropylmethylcellulose (HPMC), carboxymethylcellulose (CMC), and combinations thereof;

water in an amount from about 10 to about 50% by weight, based on the total weight of the mixture; and one or more flavoring agents.

2. The product of claim 1, wherein the cellulose derivative is hydroxypropylcellulose (HPC).

3. The product of claim 1, wherein the one or more flavoring agents comprises a compound having a carbon-carbon double bond, a carbon-oxygen double bond, a carbon-oxygen single bond, or a combination thereof.

4. The product of claim 1, wherein the one or more flavoring agents comprises one or more aldehydes, ketones, esters, terpenes, terpenoids, or a combination thereof.

5. The product of claim 1, wherein the one or more flavoring agents comprises one or more esters.

6. The product of claim 5, wherein the one or more esters are alkyl esters comprising a $C_1$-$C_8$ alkanol and a $C_2$-$C_8$ alkane carboxylic acid.

7. The product of claim 5, wherein the one or more esters comprise isoamyl acetate, ethyl hexanoate, ethyl heptanoate, allyl hexanoate, or a combination thereof.

8. The product of claim 2, wherein the cellulose derivative is HPC, present in an amount by weight from about 1 to about 3%.

9. The product of claim 1, wherein the mixture further comprises one or more salts, one or more organic acids, one or more sweeteners, one or more binding agents, one or more humectants, one or more gums, one or more active ingredients, a tobacco material, or combinations thereof.

10. The product of claim 1, wherein the mixture further comprises one or more active ingredients selected from the group consisting of a nicotine component, botanicals, stimulants, amino acids, vitamins, and cannabinoids.

11. The product of claim 1, wherein the mixture further comprises from about 0.001 to about 10% by weight of a nicotine component, calculated as the free base and based on the total weight of the mixture.

12. The product of claim 1, wherein the mixture further comprises from about 0.1 to about 0.5% by weight of one or more organic acids, based on the total weight of the mixture.

13. The product of claim 12, wherein the one or more organic acids is an alkyl carboxylic acid, an aryl carboxylic acid, or a combination of any thereof.

14. The product of claim 12, wherein the one or more organic acids is citric acid, malic acid, tartaric acid, octanoic acid, benzoic acid, a toluic acid, salicylic acid, or a combination thereof.

15. The product of claim 12, wherein the one or more organic acids is citric acid.

16. The product of claim 1, wherein the mixture further comprises a tobacco material.

17. The product of claim 16, wherein the mixture comprises no more than about 10% by weight of the tobacco material, excluding any nicotine component present, based on the total weight of the mixture.

18. The product of claim 16, wherein the tobacco material is a bleached tobacco.

19. The product of claim 1 wherein the mixture comprises no more than about 7.5 percent of alkali metal salt, based on the total weight of the mixture.

20. The product of claim 1, wherein the mixture is enclosed in a pouch to form a pouched product, the mixture optionally being in a free-flowing particulate form.

21. The product of claim 1, wherein, when measured at a time period of 1 day after preparation, the product has a concentration of one or more flavoring agents present which is greater than a concentration of the same one or more flavoring agents present in a control product which does not include the cellulose derivative, as determined by semi-quantitative Gas Chromatography-Mass Spectrometry.

22. The product of claim 1, wherein when measured at a time period of one or more of 2 days, 1 week, 2 weeks, 3 weeks, or 1 month after preparation, the product has a concentration of one or more flavoring agents present which is greater than a concentration of the same one or more flavoring agents present in a control product which does not include the cellulose derivative, as determined by semi-quantitative Gas Chromatography-Mass Spectrometry.

23. A method of stabilizing a product configured for oral use, the method comprising:

i) mixing one or more flavoring agents with a cellulose derivative selected from the group consisting of methylcellulose, hydroxyethyl cellulose, hydroxypropylcellulose (HPC), hydroxypropylmethylcellulose (HPMC), carboxymethylcellulose (CMC), and combinations thereof to form a first mixture; and ii) mixing the first mixture with microcrystalline cellulose and water to form the product, wherein the product comprises the water in an amount from about 10 to about 50% by weight, from about 1 to about 5% by weight of the cellulose derivative, and about 10 to about 60% by weight of the microcrystalline cellulose, based on the total weight of the product.

24. The method of claim 23, wherein the cellulose derivative is hydroxypropylcellulose (HPC).

25. The method of claim 23, wherein the one or more flavoring agents comprise one or more aldehydes, ketones, esters, terpenes, terpenoids, or a combination thereof.

26. The method of claim 23, wherein the one or more flavoring agents comprise one or more esters.

27. The method of claim 26, wherein the one or more esters are alkyl esters comprising a $C_1$-$C_8$ alkanol and a $C_2$-$C_8$ alkyl carboxylic acid.

28. The method of claim 26, wherein the one or more esters comprise isoamyl acetate, ethyl hexanoate, ethyl heptanoate, allyl hexanoate, or a combination thereof.

29. The method of claim 23, wherein mixing the first mixture with the microcrystalline cellulose further comprises adding one or more salts, one or more sweeteners, one or more binding agents, one or more humectants, one or more gums, one or more active ingredients, a tobacco material, or combinations thereof.

30. The method of claim 23, wherein mixing the first mixture with the microcrystalline cellulose further comprises adding one or more active ingredients selected from the group consisting of a nicotine component, botanicals, stimulants, amino acids, vitamins, and cannabinoids.

31. The method of claim 23, further comprising adding from about 0.001 to about 10% by weight of a nicotine component, calculated as the free base and based on the total weight of the product.

32. The method of claim 23, further comprising adding from about 0.1 to about 0.5% by weight of one or more organic acids, based on the total weight of the product.

33. The method of claim 32, wherein the one or more organic acids is an alkyl carboxylic acid, an aryl carboxylic acid, or a combination of any thereof.

34. The method of claim 32, wherein the one or more organic acids is citric acid, malic acid, tartaric acid, octanoic acid, benzoic acid, a toluic acid, salicylic acid, or a combination thereof.

35. The method of claim 32, wherein the one or more organic acids is citric acid.

36. The method of claim 23, further comprising enclosing the product in a pouch to form a pouched product, the product optionally being in a free-flowing particulate form.

37. The method of claim 23, wherein, when measured at a time period of 1 day after preparation, the product has a concentration of one or more flavoring agents present which is greater than a concentration of the same one or more flavoring agents present in a control product which does not include the cellulose derivative, as determined by semi-quantitative Gas Chromatography-Mass Spectrometry.

38. The method of claim 37, wherein when measured at a time period of one or more of 2 days, 1 week, 2 weeks, 3 weeks, or 1 month after preparation, the product has a concentration of one or more flavoring agents present which is greater than a concentration of the same one or more flavoring agents present in a control product which does not include the cellulose derivative, as determined by semi-quantitative Gas Chromatography-Mass Spectrometry.

39. A product configured for oral use, the product prepared by the method of claim 23.

* * * * *